US009834008B2

(12) United States Patent
Hirayama et al.

(10) Patent No.: US 9,834,008 B2
(45) Date of Patent: Dec. 5, 2017

(54) THERMAL HEAD AND THERMAL PRINTER

(71) Applicant: KYOCERA Corporation, Kyoto-shi, Kyoto (JP)

(72) Inventors: Masafumi Hirayama, Kyoto (JP); Yuuna Ookubo, Kyoto (JP); Yasumitsu Yamamoto, Kyoto (JP); Youichi Moto, Kyoto (JP); Yui Tanaka, Kyoto (JP); Hisatoshi Takada, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/321,089

(22) PCT Filed: Jun. 18, 2015

(86) PCT No.: PCT/JP2015/067620

§ 371 (c)(1),
(2) Date: Dec. 21, 2016

(87) PCT Pub. No.: WO2015/198962

PCT Pub. Date: Dec. 30, 2015

(65) Prior Publication Data

US 2017/0151809 A1 Jun. 1, 2017

(30) Foreign Application Priority Data

Jun. 24, 2014 (JP) ..... 2014-129278
Jul. 18, 2014 (JP) ..... 2014-147899

(51) Int. Cl.
*B41J 2/335* (2006.01)

(52) U.S. Cl.
CPC ..... *B41J 2/33595* (2013.01)

(58) Field of Classification Search
CPC ..... B41J 2/33595
See application file for complete search history.

(56) References Cited

U.S. PATENT DOCUMENTS 5,259,767 A 11/1993 Kurbikoff et al.
7,374,270 B2 * 5/2008 Kojima ..... B41J 29/393 347/19

FOREIGN PATENT DOCUMENTS

JP 06-203930 A 7/1994

* cited by examiner

*Primary Examiner* — Lamson Nguyen
(74) *Attorney, Agent, or Firm* — Volpe and Koenig, P.C.

(57) ABSTRACT

A thermal head includes a substrate; a heat generating section disposed on the substrate; an electrode which is disposed on the substrate and is electrically connected to the heat generating section; and a connector including a fixing ping electrically connected to the electrode, a movable pin which holds the substrate between the movable pin and the fixing pin, and a connection pin which connects the fixing pin and the movable pin. The movable pin includes a movable section which is bent or curved and a contact section making contact with the substrate. The movable pin is disposed so as to protrude from the connection pin beyond the fixing pin. The contact section is located closer to a connection pin side than a tip end of the fixing pin.

20 Claims, 15 Drawing Sheets

(a)

(b)

(a)

(b)

(a)

(b)

THERMAL HEAD AND THERMAL PRINTER

TECHNICAL FIELD

The present invention relates to a thermal head and a thermal printer.

BACKGROUND ART

Various kinds of thermal heads have been proposed conventionally as printing devices for facsimiles, video printers, etc. For example, there is known a thermal head including: a substrate, a plurality of heat generating sections disposed on the substrate, electrodes which are disposed on the substrate and are electrically connected to the heat generating sections, and a connector which holds the substrate between a base layer made of an insulating material and conductors embedded in the base layer (for example, refer to FIG. 3 in Patent Literature 1). Furthermore, in the thermal head described in Patent Literature 1, the substrate is inserted between the base layer made of an insulating material and the conductors embedded in the base layer, whereby the electrodes are electrically connected to the connector.

CITATION LIST

Patent Literature

Patent Literature 1: Japanese Unexamined Patent Publication JP-A 6-203930(1994)

SUMMARY OF INVENTION

Technical Problem

However, since the connector is fitted on the substrate in a state where the conductors embedded in the base layer are made contact with the electrodes in the above-mentioned thermal head, there is a danger that the electrodes may be broken.

Solution to Problem

A thermal head according to an embodiment of the invention includes a substrate; a heat generating section disposed on the substrate; an electrode which is disposed on the substrate and is electrically connected to the heat generating section; and a connector comprising a fixing pin electrically connected to the electrode, a movable pin which holds the substrate between the movable pin and the fixing pin, and a connection pin which connects the fixing pin to the movable pin. Furthermore, the movable pin comprises a movable section which is bent or curved and a contact section making contact with the substrate. Moreover, the movable pin is disposed so as to protrude from the connection pin beyond the fixing pin. Furthermore, the contact section is located closer to a connection pin side than a tip end of the fixing pin.

In addition, a thermal printer according to an embodiment of the invention includes the above-mentioned thermal head, a conveying mechanism which conveys a recording medium onto the heat generating section, and a platen roller which presses the recording medium against the heat generating section.

Furthermore, a method for manufacturing the thermal head according to an embodiment of the invention relates to a method for manufacturing a thermal head including a substrate; heat generating sections disposed on the substrate; an electrode which is disposed on the substrate and is electrically connected to the heat generating section; and a connector comprising a fixing pin electrically connected to the electrode, a movable pin which holds the substrate between the movable pin and the fixing pin, and a connection pin which connects the fixing pin to the movable pin; the movable pin comprising a movable section which is bent or curved and a contact section making contact with the substrate; the movable pin being disposed so as to protrude from the connection pin beyond the fixing pin; and the contact section being located closer to a connection pin side than a tip end of the fixing pin. Furthermore, the method comprises, while pressing the movable pin downwardly, inserting the substrate between the fixing pin and the movable pin and releasing a downwardly pressing force, and thereby electrically connecting the electrode and the fixing pin.

Advantageous Effects of Invention

It is possible to reduce the possibility that the electrodes may be broken.

BRIEF DESCRIPTION OF DRAWINGS

FIG. 10(*a*) is a cross-sectional view, and FIG. 10(*b*) is a perspective view showing a connector pin;

FIG. 12(*b*) is a cross-sectional view taken along the line III-III of FIG. 11(*a*);

DESCRIPTION OF EMBODIMENTS

First Embodiment

Figure 1:
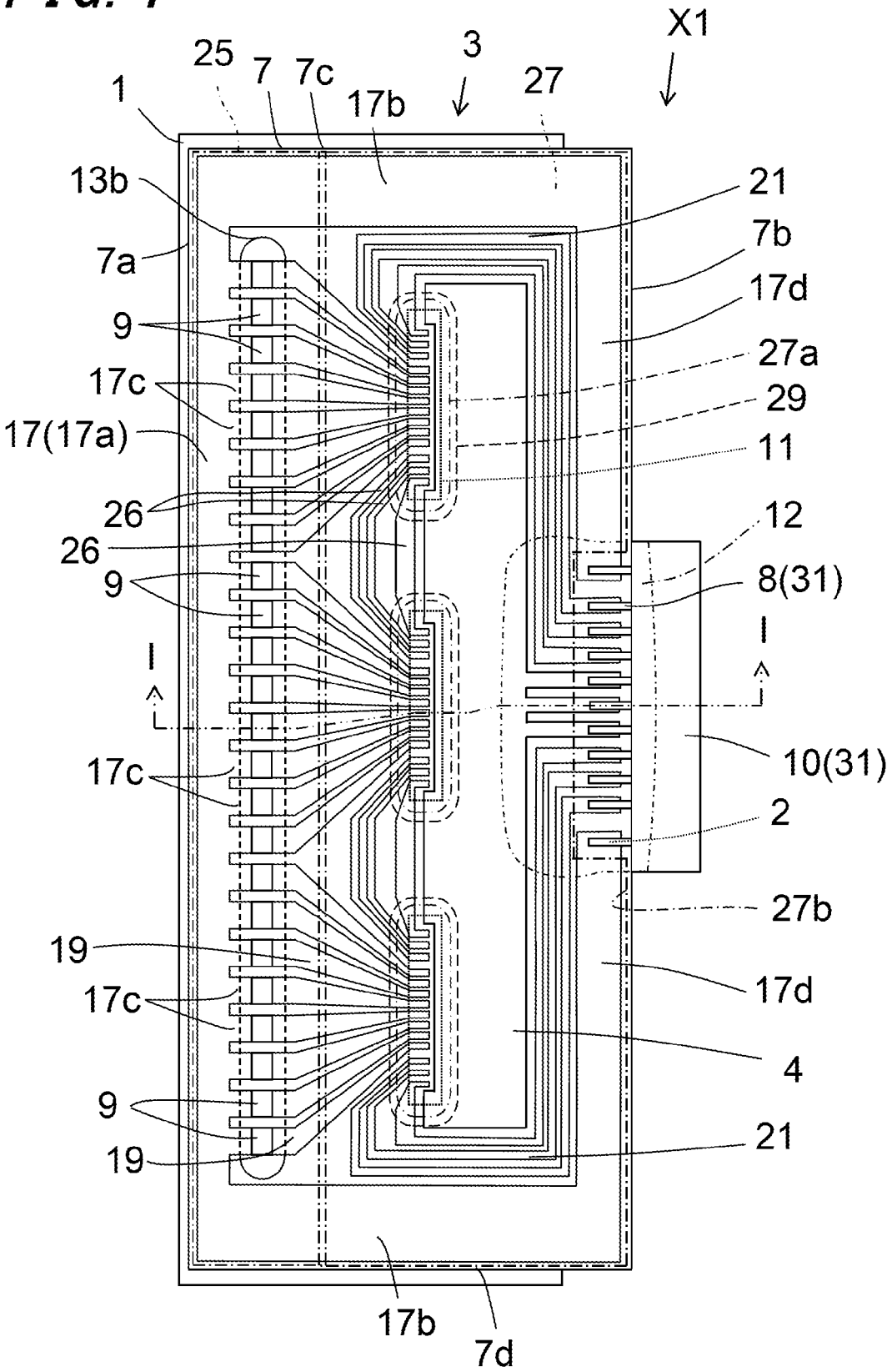
FIG. 1 is a plan view showing a thermal head according to a first embodiment.

A thermal head X1 will be described below referring to FIGS. 1 to 7. In FIG. 1, a protection layer 25, a covering layer 27 and a covering member 12 are indicated by dashed-dotted lines for simplification. Furthermore, in FIG. 5(*a*), the covering member 12 is indicated by a dashed-dotted line for simplification. Moreover, in FIGS. 6 and 7, the protection layer 25 and the covering layer 27 are omitted.

The thermal head X1 includes a radiator 1, a head base body 3 disposed on the radiator 1, and a connector 31 connected to the head base body 3.

The radiator 1 has a rectangular parallelepiped shape and is made of, for example, a metal material such as copper, iron or aluminum. The radiator 1 has a function of radiating heat which does not contribute to printing from the heat generated by the heat generating sections 9 of the head base body 3. In addition, the head base body 3 is bonded to the upper face of the radiator 1 with, for example, a double-sided tape or an adhesive (not shown).

The head base body 3 is formed into a rectangular shape in a plan view thereof, and various members constituting the thermal head X1 are disposed on the substrate 7 of the head base body 3. The head base body 3 has a function of performing printing on a recording medium (not shown) according to an electrical signal supplied from the outside.

Figure 2:
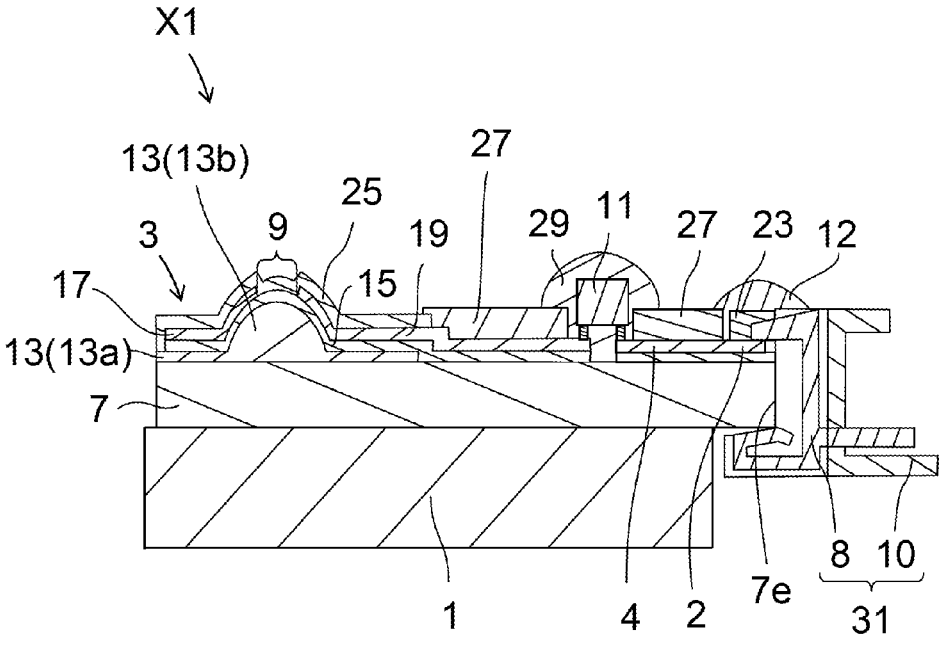
FIG. 2 is a cross-sectional view taken along the line I-I of FIG. 1.
Figure 3:
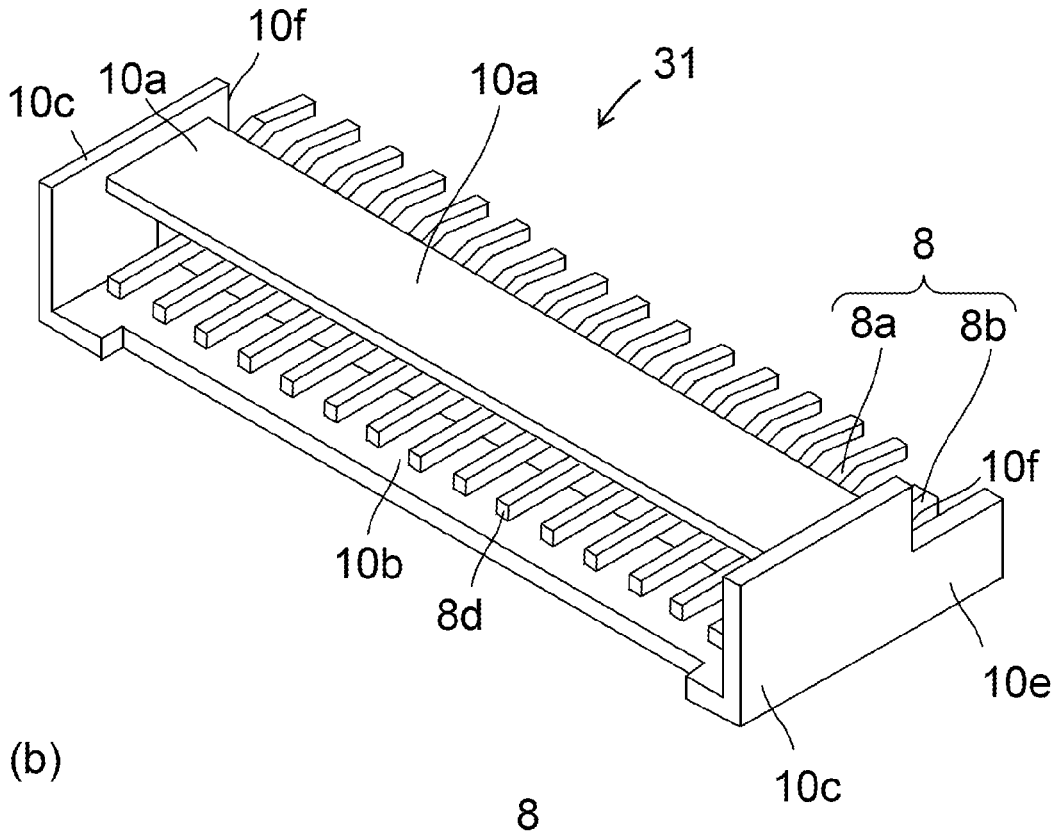
FIG. 3 shows a connector constituting the thermal head according to the first embodiment, wherein FIG. 3(*a*) is a perspective view, and FIG. 3(*b*) is a partially enlarged perspective view.
Figure 3:
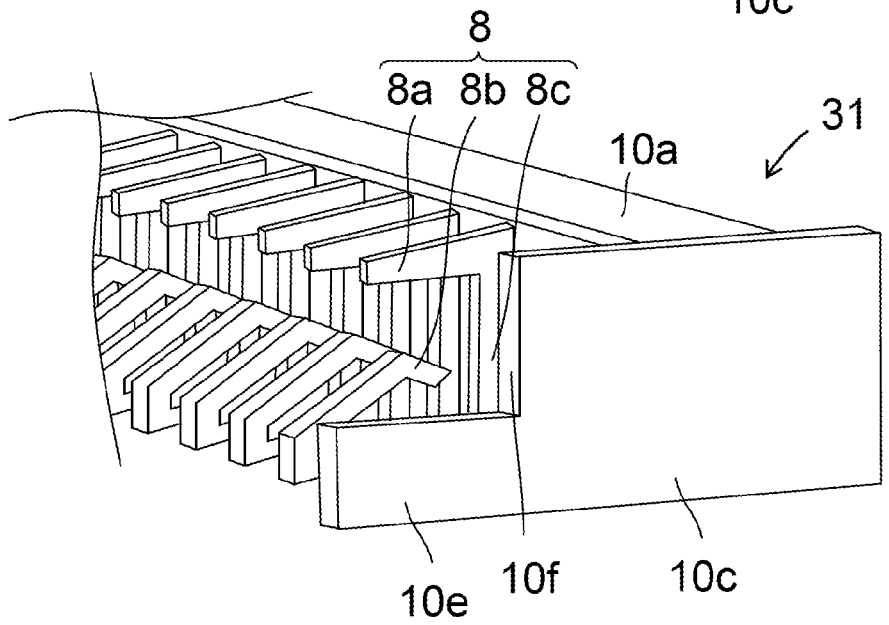
Figure 4:
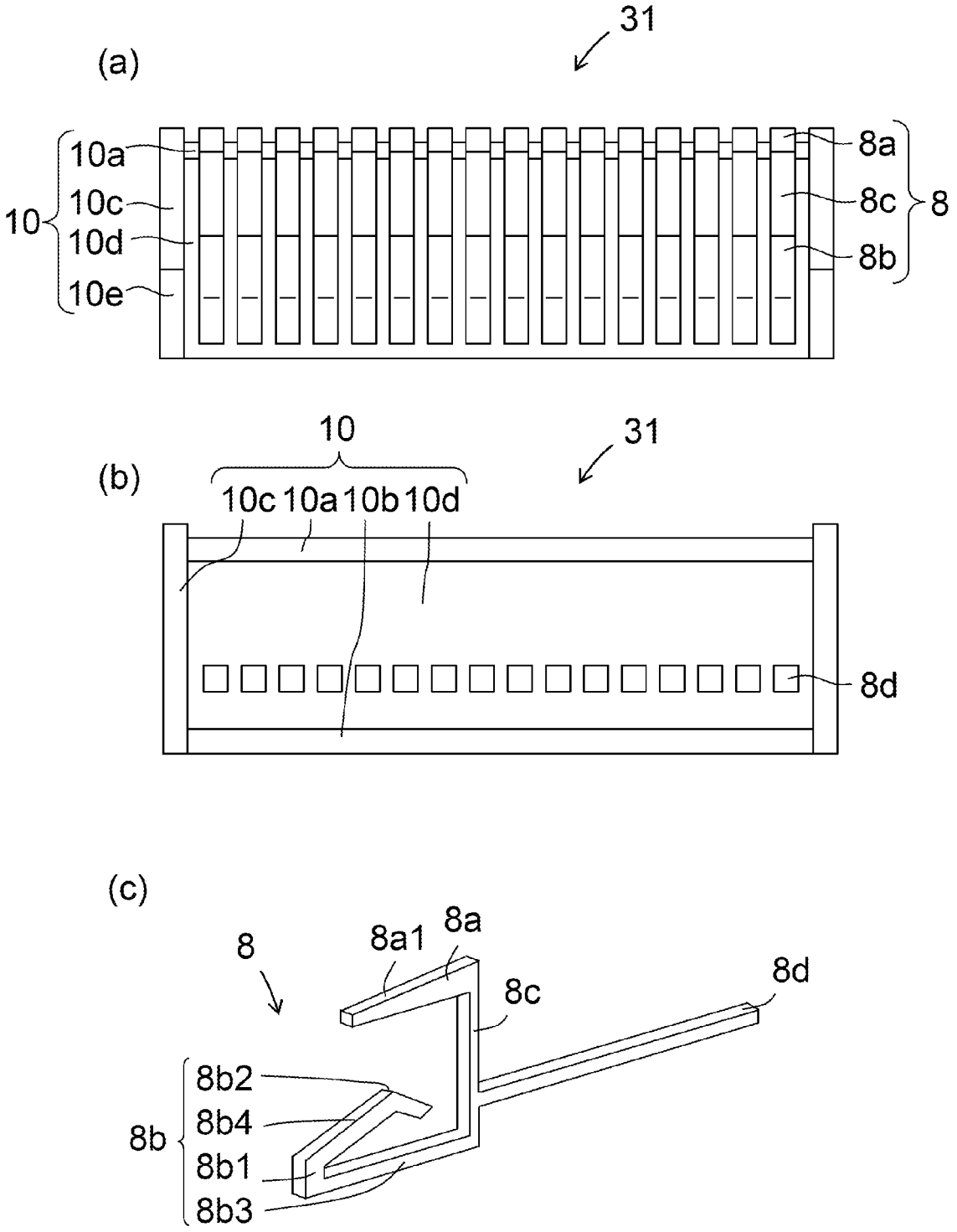
FIG. 4 shows a connector constituting the thermal head according to the first embodiment, wherein FIG. 4(*a*) is a front view, FIG. 4(*b*) is a rear view, and FIG. 4(*c*) is a perspective view showing a connector pin constituting the connector.
Figure 5:
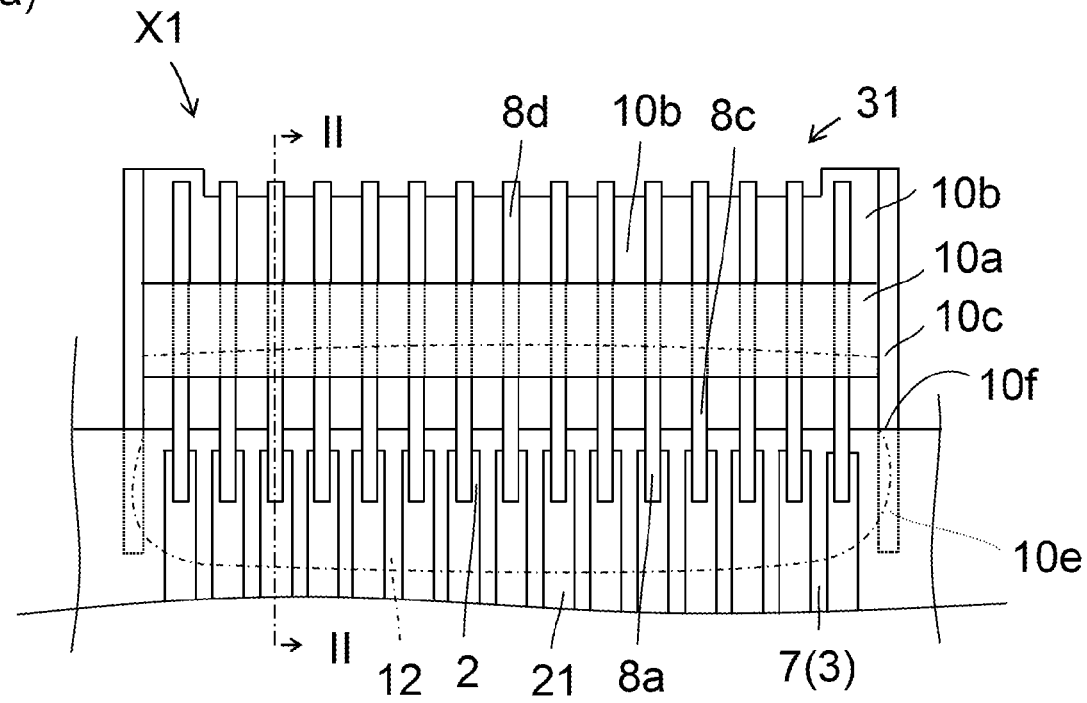
FIG. 5 is an enlarged view showing the vicinity of the connector of the thermal head according to the first embodiment, wherein FIG. 5(*a*) is a plan view, and FIG. 5(*b*) is a bottom view.
Figure 5:
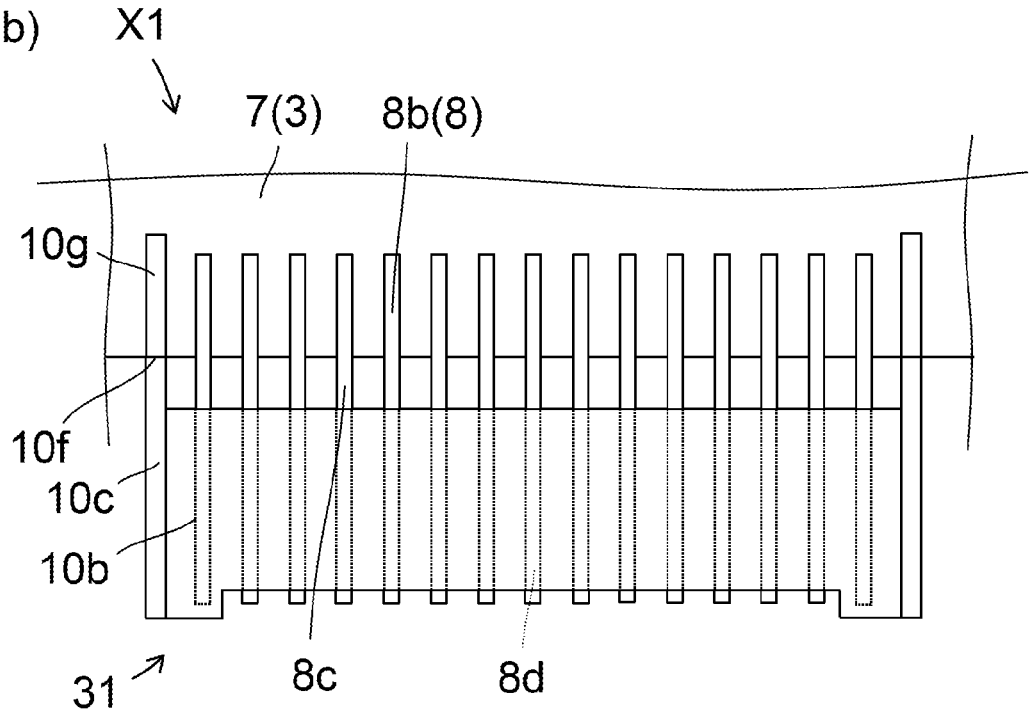
Figure 6:
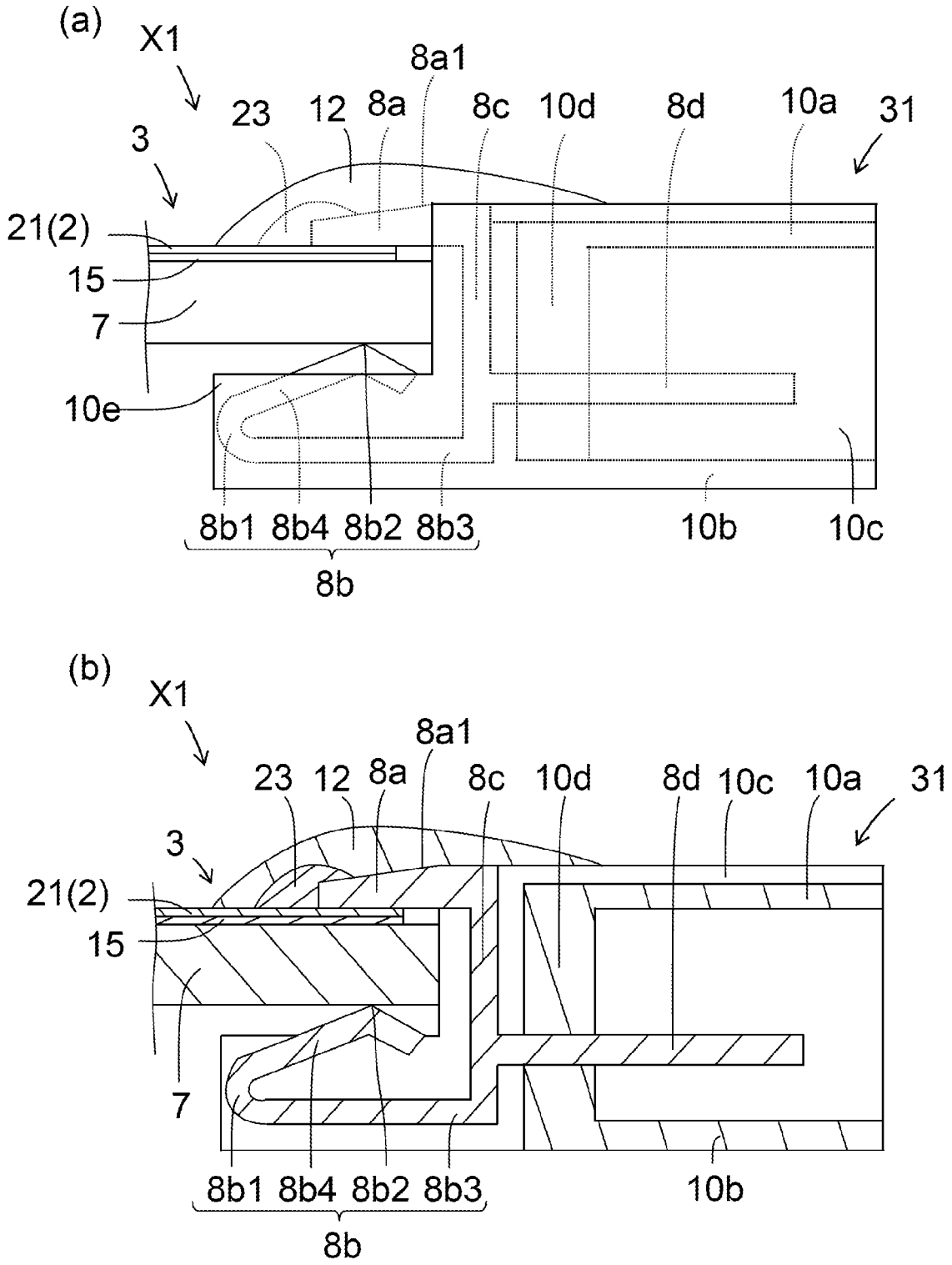
FIG. 6(*a*) is an enlarged side view showing the vicinity of the connector of the thermal head according to the first embodiment, and FIG. 6(*b*) is a cross-sectional view taken along the line II-II of FIG. 5(*a*)

The connector 31 includes a plurality of connector pins 8 and a housing 10 which accommodates the plurality of connector pins 8 as shown in FIG. 2. One sides of the plurality of connector pins 8 are exposed to the outside of the housing 10, and the other sides thereof are accommodated inside the housing 10. The plurality of connector pins 8 has a function of ensuring electrical conduction between the various kinds of electrodes of the head base body 3 and power sources disposed outside the housing, and the plurality of connector pins 8 are electrically independent of one another. The housing 10 is not necessarily required.

The respective members constituting the head base body 3 will be described below.

The substrate 7 is disposed on the radiator 1 and has a rectangular shape in a plan view. Hence, the substrate 7 has one long side 7*a* and the other long side 7*b* and also has one short side 7*c* and the other short side 7*d*. Furthermore, the substrate 7 has a side face 7*e* on the side of the other long side 7*b*. The substrate 7 is made of, for example, an electrically insulating material such as alumina ceramics, or a semiconductor material such as single-crystal silicon.

A heat storage layer 13 is formed on the upper face of the substrate 7. The heat storage layer 13 includes a base section 13*a* and a protruding section 13*b*. The base section 13*a* is formed on the left half of the upper face of the substrate 7. Furthermore, the base section 13*a* is disposed close to the heat generating sections 9 and disposed below the protection layer 25 described later. The protruding section 13*b* extends in a belt shape along the arrangement direction of the plurality of heat generating sections 9 and has a substantially semielliptical shape in cross section. Moreover, the protruding section 13*b* has a function of properly pressing a recording medium P (see FIG. 8) on which printing is performed, against the protection layer 25 formed on the heat generating sections 9.

The heat storage layer 13 is made of glass having a low thermal conductivity and temporarily stores part of the heat generated at the heat generating sections 9. Hence, the heat storage layer 13 can shorten the time required to raise the temperature of the heat generating sections 9 and has a function of raising the thermal response characteristic of the thermal head X1. The heat storage layer 13 is formed, for example, by applying a predetermined glass paste obtained by mixing glass powder with an appropriate organic solvent, onto the upper face of the substrate 7 using a known screen printing or otherwise and by firing the glass paste.

An electric resistance layer 15 is disposed on the upper face of the heat storage layer 13, and connection terminals 2, a ground electrode 4, a common electrode 17, individual electrodes 19, IC-connector connection electrodes 21 and IC-IC connection electrodes 26 are disposed on the electric resistance layer 15. The electric resistance layer 15 is patterned into a shape identical with the shape formed by the connection terminals 2, the ground electrode 4, the common electrode 17, the individual electrodes 19, the IC-connector connection electrodes and the IC-IC connection electrodes 28, and the electric resistance layer 15 has exposed regions that are exposed in the areas between the common electrode 17 and the individual electrodes 19. The exposed regions of the electric resistance layer 15 are disposed in rows on the protruding section 13*b* of the heat storage layer 13, whereby the respective exposed regions constitute the heat generating sections 9.

Although the plurality of heat generating sections 9 is shown simply in FIG. 1 for convenience of explanation, the plurality of heat generating sections 9 are disposed at a density of, for example, 100 to 2400 dpi (dots per inch). The electric resistance layer 15 is made of, for example, a material having a relatively high electric resistance, such as a TaN-based, based, TaSiO-based, TaSiNO-based, TaSiO-based or TiSiCO-based material. Hence, when voltage is applied to the heat generating sections 9, the heat generating sections 9 generate heat by Joule heat.

As shown in FIGS. 1 and 2, the connection terminals 2, the ground electrode 4, the common electrode 17, the plurality of individual electrodes 19, the IC-connector connection electrodes 21 and the IC-IC connection electrodes 26 are disposed on the upper face of the electric resistance layer 15. The connection terminals 2, the ground electrode 4, the common electrode 17, the individual electrodes 19, the IC-connector connection electrodes 21 and the IC-IC connection electrodes 26 are made of conductive materials, for example, one metal of aluminum, gold, silver and copper, or an alloy of these metals.

The common electrode 17 includes main wiring sections 17*a* and 17*d*, auxiliary wiring sections 17*b* and lead sections 17*c*. The main wiring section 17*a* extends along the one long side 7*a* of the substrate 7. The auxiliary wiring sections 17*b* extend along the one short side 7*c* and the other short side 7*d* of the substrate 7, respectively. The lead sections 17*c* extend individually toward the respective heat generating sections 9 from the main wiring section 17*a*. The main wiring section 17*d* extends along the other long side 7*b* of the substrate 7.

The common electrode 17 electrically connects the plurality of heat generating sections 9 to the connector 31. The main wiring section 17*a* may be formed of a thick electrode section (not shown) thicker than the other portion of the common electrode 17 to lower the electric resistance value of the main wiring section 17*a*. In that case, the electric capacity of the main wiring section 17*a* can be made larger.

The plurality of individual electrodes 19 electrically connect the heat generating sections 9 to drive ICs 11. Furthermore, the individual electrodes 19 divide the plurality of heat generating sections 9 into a plurality of groups and electrically connect the heat generating sections 9 of the respective groups to the drive ICs 11 disposed corresponding to the respective groups.

The plurality of IC-connector connection electrodes 21 electrically connect the drive ICs 11 to the connector 31. The plurality of IC-connector connection electrodes 21 connected to the respective drive ICs 11 is formed of a plurality of wires having different functions.

The ground electrode 4 is disposed so as to surround the individual electrodes 19, the IC-connector connection electrodes 21 and the main wiring section 17*d* of the common electrode 17 and has a wide area. The potential of the ground electrode 4 is held at a ground potential of 0 to 1 V.

The connection terminals 2 are disposed on the other long side 7*b* of the substrate 7 so as to connect the common electrode 17, the individual electrodes 19, the IC-connector connection electrodes 21 and the ground electrode 4 to the connector 31. The connection terminals 2 are disposed corresponding to the connector pins 8, and when connected to the connector 31, the connection terminals 2 are electrically connected to the connector pins 8 so as to be electrically independent of one another.

The plurality of IC-IC connection electrodes 26 electrically connect the drive ICs 11 adjacent to each other. The plurality of IC-IC connection electrodes 26 is respectively disposed corresponding to the IC-connector connection electrodes 21, thereby transmitting various kinds of signals to the drive ICs 11 adjacent to each other.

The electric resistance layer 15, the connection terminals 2, the common electrode 17, the individual electrodes 19, the ground electrode 4, the IC-connector connection electrodes 21 and the IC-IC connection electrodes 26 described above are formed, for example, by sequentially laminating the material layers constituting the respective electrodes on the heat storage layer 13 by a known thin-film forming technology such as a sputtering method, and then processing the laminated body into a predetermined pattern by a known photoetching method or otherwise. The connection terminals 2, the common electrode 17, the individual electrodes 19, the ground electrode 4, the IC-connector connection electrodes 21 and the IC-IC connection electrodes 26 can be formed in the same process simultaneously.

The drive ICs 11 are disposed corresponding to the respective groups of the plurality of heat generating sections 9 and are connected to the other end portions of the individual electrodes 19 and the one end portions of the IC-connector connection electrodes 21 as shown in FIG. 1. The drive IC 11 has a function of controlling the conduction states of the respective heat generating sections 9. A switching member having a plurality of switching elements inside may merely be used as the drive IC 11.

The drive IC 11 is sealed with a hard coat 29 formed of a resin such as an epoxy resin or a silicone resin, in a state of being connected to the individual electrodes 19, the IC-IC connection electrodes 26 and the IC-connector connection electrodes 21.

As shown in FIGS. 1 and 2, the protection layer 25 which covers the heat generating sections 9, part of the common electrode 17 and parts of the individual electrodes 19 is formed on the heat storage layer 13 which is formed on the upper face of the substrate 7.

The protection layer 25 protects covered regions of the heat generating sections 9, the common electrode 17 and the individual electrodes 19 from corrosion caused by the deposition of moisture or the like contained in the air or from abrasion caused by the contact with a recording medium on which printing is performed. The protection layer 25 can be formed by using SiN, $SiO_2$, SiON, SiC, diamond-like carbon or the like, and the protection layer 25 may be formed of a single layer or may be formed by laminating these layers. The protection layer 25 described above can be manufactured by using a thin-film forming technology such as a sputtering method, or a thick-film forming technology such as screen printing.

In addition, as shown in FIGS. 1 and 2, the covering layer 27 which partially covers the common electrode 17, the individual electrodes 19 and the IC-connector connection electrodes 21 is disposed on the substrate 7. The covering layer 27 protects the covered regions of the common electrode 17, the individual electrodes 19, the IC-IC connection electrodes 26 and the IC-connector connection electrodes 21 from oxidation caused by the contact with the air or from corrosion caused by the deposition of moisture or the like contained in the air. The covering layer 27 can be, for example, formed of a resin material such as an epoxy resin or a polyimide resin, by using a thick-film forming technology such as screen printing.

In the covering layer 27, openings 27*a* are formed so that the individual electrodes 19, the IC-IC connection electrodes 26 and the IC-connector connection electrodes 21 to be connected to the drive ICs 11 are exposed therefrom. Furthermore, the wires exposed from the openings 27*a* are connected to the drive ICs 11. Moreover, the covering layer 27 is provided with an opening 27*b* on the side of the other long side 7*b* of the substrate 7 so that the connection terminals 2 are exposed therefrom. The connection terminals 2 exposed from the opening 27*b* are electrically connected to the connector pins 8.

The connector 31 is fixed to the head base body 3 using the connector pins 8, a conductive joining material 23 and the covering member 12. As shown in FIGS. 1 and 2, the connector pins 8 are disposed on the connection terminal 2 of the ground electrode 4 and on the connection terminals 2 of the IC-connector connection electrodes 21. As shown in FIG. 2, the connection terminals 2 are electrically connected to the connector pins 8 by the conductive joining material 23.

Solder or an anisotropic conductive adhesive formed of conductive particles mixed in an electric insulation resin can be taken as an example of the conductive joining material 23. In this embodiment, solder is used for explanation. The connector pins 8 are electrically connected to the connection terminals 2 by covering the connector pins 8 with the conductive joining material 23. A plated layer (not shown) which is plated with Ni, Au or Pd may be disposed between the conductive joining material 23 and the connection terminals 2. However, the conductive joining material 23 may not be necessarily required.

The covering member 12 is disposed so that the connection terminals 2 and fixing pins 8*a* are not exposed to the outside, and can be formed of, for example, an epoxy-based thermosetting resin, an ultraviolet curing resin or a visible light curing resin.

As shown in FIGS. 3 to 7, the connector 31 includes the plurality of connector pins 8 and the housing 10 which accommodates the plurality of connector pins 8.

The connector pin 8 includes the fixing pin 8*a*, a movable pin 8*b*, a connection pin 8*c* and an extraction pin 8*d*. The fixing pin 8*a* and the movable pin 8*b* of the connector pin 8 are connected by the connection pin 8*c*, and the extraction pin 8*d* is extracted from the connection pin 8*c*. Hence, the fixing pin 8*a*, the movable pin 8*b*, the connection pin 8*c* and the extraction pin 8*d* are formed integrally. The plurality of connector pins 8 is arranged at intervals along the main scanning direction thereof. The connector pins 8 are mutually separated, and the adjacent connector pins 8 are electrically insulated from each other.

The fixing pin 8*a* is disposed above the substrate 7 of the head base body 3 and disposed on the connection terminal 2. The movable pin 8*b* is disposed below the substrate 7 of the head base body 3, and the substrate 7 is held between the fixing pin 8*a* and the movable pin 8*b*. The movable pin 8*b* is disposed so as to protrude from the connection pin 8*c* beyond the fixing pin 8*a*.

The connection pin 8*c* connects the fixing pin 8*a* to the movable pin 8*b* and is disposed so as to extend in the thickness direction of the substrate 7. The extraction pin 8*d* is extracted in a direction away from the head base body 3 and joined to the housing 10. The connector 32 and the head base body 3 are electrically and mechanically joined to each other by inserting the head base body 3 between the fixing pins 8*a* and the movable pins 8*b*.

The thickness of a portion of the fixing pin 8*a* on the side close to the connection pin 8*c* is made larger than that the portion of the fixing pin 8*a* on the side away from the connection pin 8*c*. Hence, the thickness of the fixing pin 8*a* becomes gradually larger as the fixing pin 8*a* becomes closer to the connection pin 8*c*. For this reason, the fixing pin 8*a* has an inclined region 8*a*1 whose thickness becomes larger toward the connection pin 8*c*. Furthermore, the lower face of the fixing pin 8*a* is formed into a flat shape and disposed on the connection terminal 2. Hence, the connection area between the connection terminal 2 and the fixing pin 8*a* can be increased, and the electrical reliability of the thermal head X1 can be improved.

The movable pin 8*b* includes a movable section 8*b*1, a contact section 8*b*2, a first extension section 8*b*3 and a second extension section 8*b*4. The movable section 8*b*1 is formed into a bent shape and can be deformed elastically when the substrate 7 is inserted. However, the movable section 8*b*1 may be formed into a curved shape.

The contact section 8*b*2 is disposed so as to make contact with the lower face of the substrate 7, and the substrate 7 is held between the fixing pin 8*a* and the contact section 8*b*2. The first extension section 8*b*3 extends from the connection pin 8*c* toward the substrate 7 and is connected to the movable section 8*b*1. The second extension section 8*b*4 extends from the movable section 8*b*1 toward the connection pin 8*c* and is connected to the contact section 8*b*2. The contact section 8*b*2 is located closer to the connection pin 8*c* side than on the tip end of the fixing pin 8*a*, and the contact section 8*b*2 is disposed below the fixing pin 8*a*.

The movable section 8*b*1, the contact section 8*b*2, the first extension section 8*b*3 and the second extension section 8*b*4 of the movable pin 8*b* are formed integrally. In other words, the movable pin 8*b* is configured so as to extend from the connection pin 8*c* toward the substrate 7 and then so as to be bent at the movable pin 8*b* and to extend toward the connection pin 8*c* while being inclined. As a result, the movable pin 8*b* is formed so as to be elastically deformable in the thickness direction of the substrate 7.

The connection pin 8*c* connects the fixing pin 8*a* to the movable pin 8*b* and is disposed so as to extend in the thickness direction of the substrate 7. The extraction pin 8*d* is connected to the connection pin 8*c*, and when a cable (not shown) is connected to the extraction pin 8*d* from the outside, voltage is supplied to the thermal head X1.

Since the connector pin 8 requires conductivity, the connector pin 8 can be made of a metal or an alloy.

The housing 10 is formed into a box shape and has a function of accommodating the respective connector pins 8 in a state where the connector pins are electrically independent of one another. A socket connected to a cable is inserted from the outside into the opening portion of the housing 10, and electricity is supplied to the head base body 3 by connecting/disconnecting a cable or the like disposed externally.

The housing 10 includes an upper wall 10*a*, a lower wall 10*b*, side walls 10*c*, a front wall 10*d*, support sections 10*e* and positioning sections 10*f*. An opening portion is formed on the extraction pin 8*d* side of the connector pin 8 by the upper wall 10*a*, the lower wall 10*b*, the side walls 10*c* and the front wall 10*d* of the housing 10.

The support section 10*e* is disposed in a state of protruding from the side wall 10*c* toward the lower side of the substrate 7, and the support section 10*e* is disposed in a state of being separated from the substrate 7. In addition, the support section 10*e* protrudes from the housing 10 beyond the connector pin 8.

The positioning sections 10*f* have a function of positioning the inserted head base body 3, and are disposed closer to the substrate 7 than the connection pins 8*c* of the connector pins 8. Since the housing 10 includes the positioning sections 10*f*, the head base body 3 is configured so as not to abut on the connection pins 8*c* of the connector pins 8, whereby the possibility that the connection pins 8*c* may be broken due to bending or the like can be reduced.

In the case of the conventional connector, the movable pins thereof are disposed on the upper side of the substrate, and when the substrate is inserted into the connector, there is a possibility that the connection terminals disposed on the upper face of the substrate may wear and be broken and that the electrical connection between the head base body and the connector may be cut off.

On the other hand, since the movable pins 8*b* protrude beyond the fixing pins 8*a* in the thermal head X1, when the substrate 7 is inserted into the connector 31, the substrate 7 makes contact with the movable pins 8*b* earlier than the fixing pins 8*a*. Hence, the movable pins 8*b* are deformed downwardly, whereby the substrate 7 can be inserted in a state where a clearance is formed between the fixing pins 8*a* and the substrate 7. As a result, it is possible to reduce the possibility that the connection terminals 2 may make contact with the fixing pins 8*a* and may wear. For this reason, it is possible to reduce the possibility that the connection terminals 2 may be broken by the fixing pins 8*a* and to ensure the reliability of the electrical connection between the thermal head X1 and the outside.

Furthermore, the contact section 8*b*2 is located closer to the connection pin 8*c* side than the tip end of the fixing pin 8*a*, whereby the contact section 8*b*2 operates so as to cause the substrate 7 to abut on the lower face of the fixing pin 8*a*. Hence, it is possible to reduce the possibility that a rotational moment in the thickness direction of the substrate 7 may be generated, and to reduce the possibility that the substrate 7 may be rotated.

Still further, since the recording medium P (see FIG. 8) is transferred onto the connector 31 in the thermal head X1, the height of the covering member 12 is preferably low so that the covering member 12 does not make contact with the recording medium P.

In this respect, in the thermal head X1, the fixing pins 8*a* are disposed on the upper face side of the substrate 7 on which the heat generating sections 9 are disposed, and the movable pins 8*b* are disposed on the lower side of the substrate 7, whereby it is possible to reduce the possibility that the connection terminals 2 may be broken without making the height of the thermal head X1 on the upper face side of the substrate 7 large.

The fixing pin 8*a* includes the inclined region 8*a*1 whose thickness becomes larger toward the connection pin 8*c*. Hence, the rigidity of the fixing pin 8*a* becomes higher toward the connection pin 8*c*, whereby it is possible to lower the rigidity of the end portion of the fixing pin 8*a* to which the substrate 7 is inserted and to enhance the rigidity of the joining portion between the fixing pin 8*a* and the connection pin 8*c*. For this reason, the substrate 7 can be easily inserted between the fixing pins 8*a* and the movable pins 8*b*, and it is possible to reduce the possibility that the connector pins 8*a* may be deformed when the substrate 7 abuts on the housing 10.

The upper end of the fixing pin 8*a* is located below the highest portion of the housing 10. Hence, it is possible to lower the height of the covering member 12 disposed on the fixing pin 8*a*, whereby it is possible to reduce the possibility that the covering member 12 may make contact with the recording medium P (see FIG. 8) to be transferred over the substrate 7. Consequently, it is possible to reduce the possibility that the recording medium P may be damaged and that the connector 31 may be displaced.

In the case where part of the extraction pin 8*d* is joined to the front wall 10*d* of the housing 10 at a position below the contact section 8*b*2, when a cable (not shown) is connected to the housing 10, an external force may be generated in the housing 10 downward in the thickness direction of the substrate 7 in some cases. In such a case, since the fixing pin 8*a* is fixed, a rotational moment is generated about the connection section of the fixing pin 8*a* and the connection terminal 2, and the movable pin 8*b* is deformed upwardly about the joining section between the first extension section 8*b*3 and the connection pin 8*c*.

Even in that case, since the movable section 8*b*1 of the movable pin 8*b* is deformed, an upwardly external force is less prone to be generated in the substrate 7. As a result, stress is suppressed from being generated between the connection terminal 2 and the fixing pin 8*a*, whereby it is possible to improve the reliability of the electrical connection between the thermal head X1 and the outside.

The joining between the head base body 3 and the connector 31 will be described below referring to FIG. 7.

The substrate 7 on which the respective members constituting the head base body 3 are formed, and the connector 31 are prepared. At this time, the conductive joining material 23 (see FIG. 2), the covering member 12 (see FIG. 2) and the hard coat 29 (see FIG. 2) are not formed on the substrate 7.

Next, the head base body 3 is inserted in a space between the fixing pins 8*a* and the movable pins 8*b*. At the time, as shown in FIG. 7(*a*), the substrate 7 is inserted while pressing the movable pins 8*b* downwardly so that a clearance is generated between the fixing pins 8*a* and the substrate 7. Since the substrate 7 is inserted in a state where the lower face of the substrate 7 makes contact with the support sections 10*e* of the housing 10, it is possible to reduce the possibility that the movable pins 8*b* may be deformed excessively.

Figure 7:
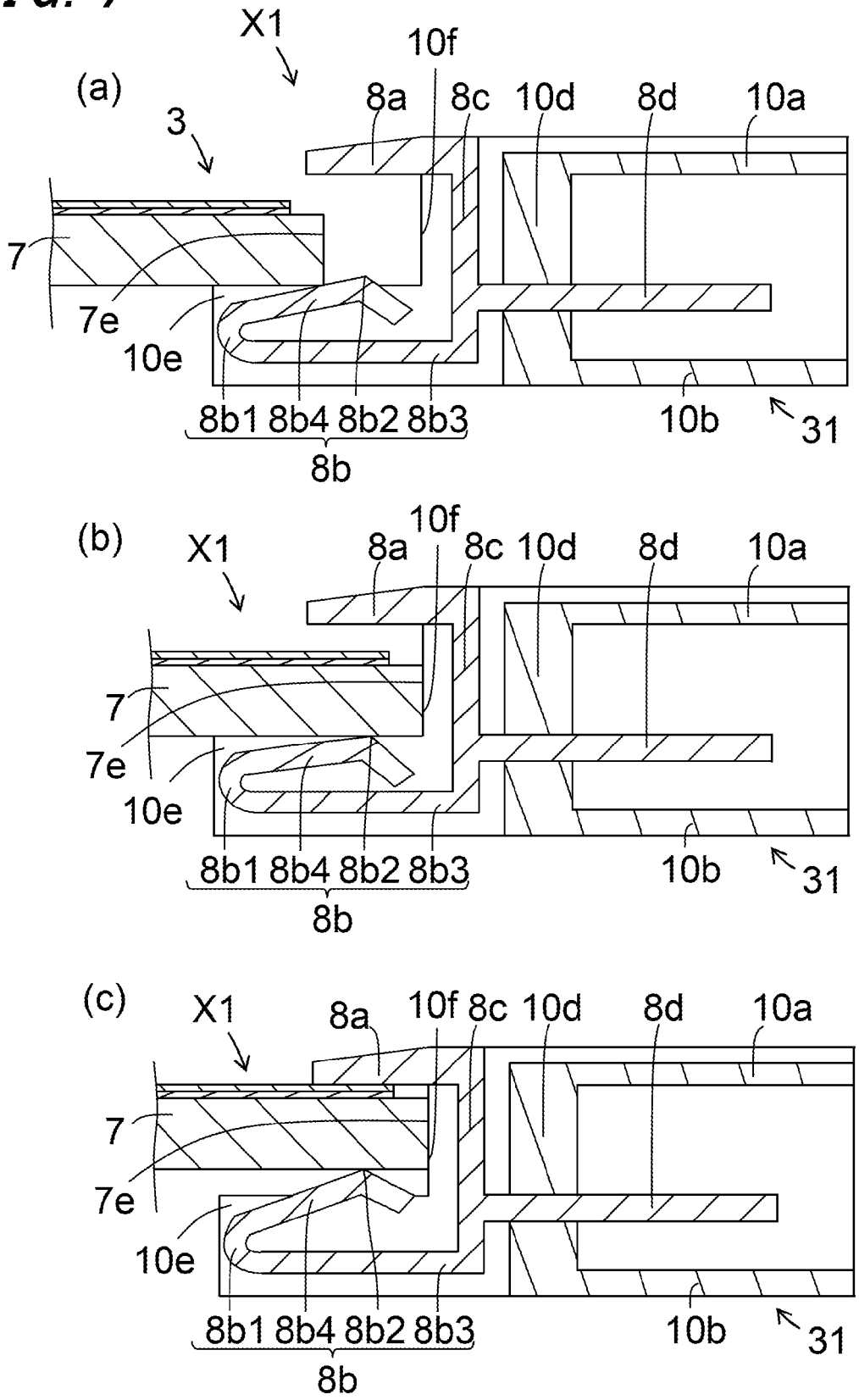
FIGS. 7(*a*) to 7(*c*) are cross-sectional views showing a process for joining the connector to a substrate.

Next, as shown in FIG. 7(*b*), the end face 7*e* of the substrate 7 abuts on the positioning sections 10*f* of the housing 10. As a result, the head base body 3 can be positioned with respect to the connector 31.

Next, the downwardly pressing force applied to the movable pins 8*b* is released. Hence, the movable pins 8*b* are deformed upwardly, and the substrate 7 is pressed upwardly. Furthermore, since the substrate 7 displaced upwardly makes contact with the fixing pins 8*a*, whereby the substrate 7 is joined to the connector 31 and held between the fixing pins 8*a* and the movable pins 8*b* as shown in FIG. 7(*c*).

In the thermal head X1, the connection terminals 2 can be electrically connected to the fixing pins 8*a* by inserting the substrate 7 between the fixing pins 8*a* and the movable pins 8*b* while pressing the movable pins 8*b* downwardly and then by releasing the downwardly pressing force as described above. As a result, it is possible to reduce the possibility that the connection terminals 2 may be shaved by the fixing pins 8*a* and to ensure the electrical connection between the thermal head X1 and the outside.

Next, the conductive joining material 23 is applied to the respective fixing pins 8*a* by printing and then reflowed. As a result, the connector 31 and the substrate 7 are electrically connected and mechanically joined firmly by the conductive joining material 23.

Next, the covering member 12 is applied so as to cover the fixing pins 8*a* and the connection terminals 2. In the case where the covering member 12 is formed of a thermosetting resin, the head base body 3 to which the covering member 12 is applied is placed on the radiator 1 on which a double-sided tape or the like is provided. Then, the covering member 12 is cured. The substrate 7 may be joined to the radiator 1 after the covering member 12 is cured, or the covering member 12 may be applied and cured after the substrate 7 is joined to the radiator 1. The thermal head X1 can be manufactured as described above.

Next, a thermal printer Z1 will be described referring to FIG. 8.

Figure 8:
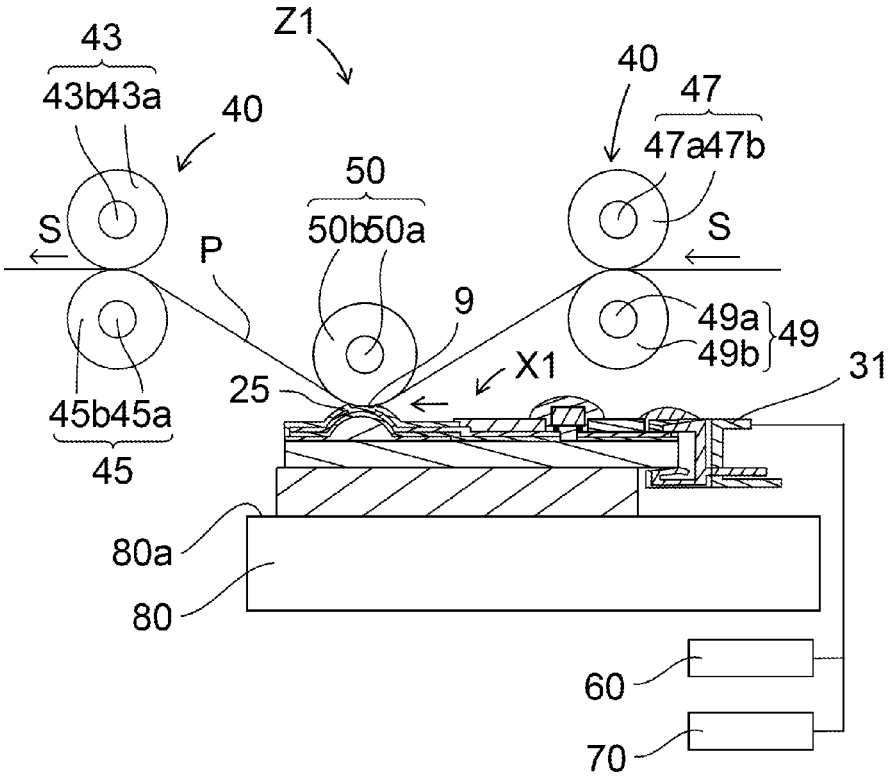
FIG. 8 is a schematic view showing a thermal printer according to the first embodiment.

As shown in FIG. 8, the thermal printer Z1 according to this embodiment includes the above-mentioned thermal head X1, a conveying mechanism 40, a platen roller 50, a power source device 60, and a control device 70. The thermal head X1 is installed on the mounting face 80*a* of the mounting member 80 disposed on the housing (not shown) of the thermal printer Z1. The thermal head X1 is installed on the mounting member 80 along the main scanning direction which is orthogonal to the conveying direction of the recording medium P described later.

The conveying mechanism 40 has a drive section (not shown) and conveying rollers 43, 45, 47 and 49. The conveying mechanism 40 conveys the recording medium P such as heat sensitive paper or image receiving paper to which ink is transferred, in the direction of the arrow S shown in FIG. 8 onto the protection layer 25 located on the plurality of heat generating sections 9 of the thermal head X1. The drive section has a function of driving the conveying rollers 43, 45, 47 and 49, and for example, a motor can be used as the drive section. The conveying rollers 43, 45, 47 and 49 can be configured by covering cylindrical shafts 43*a*, 45*a*, 47*a* and 49*a* made of a metal such as stainless steel, with elastic members 43*b*, 45*b*, 47*b* and 49*b* made of butadiene rubber or the like, for example. In the case where the recording medium P is, for example, image receiving paper to which ink is transferred, an ink film is conveyed together with the recording medium P between the recording medium P and the heat generating sections 9 of the thermal head X1.

The platen roller 50 has a function of pressing the recording medium P against the protection layer 25 located on the heat generating sections 9 of the thermal head X1. The platen roller 50 is disposed so as to extend in the direction orthogonal to the conveying direction S of the recording medium P, and both end portions thereof are supported and fixed so as to be rotatable in a state of pressing the recording medium P against the heat generating sections 9. The platen roller 50 can be configured, for example, by covering a cylindrical shaft 50*a* made of a metal such as stainless steel, with an elastic member 50*b* made of butadiene rubber or the like, for example.

The power source device 60 has a function of supplying a current for generating heat from the heat generating sections 9 of the thermal head X1 and a current for driving the drive ICs 11 as described above. The control device 70 has a function of supplying control signals for controlling the operations of the drive ICs 11 to the drive ICs 11 in order to selectively heat the heat generating sections 9 of the thermal head X1 as described above.

As shown in FIG. 8, in the thermal printer Z1, while the recording medium P is pressed against the heat generating sections 9 of the thermal head X1 by the platen roller 50 and is conveyed onto the heat generating sections 9 by the conveying mechanism 40, the heat generating sections 9 selectively generate heat by the power source device 60 and the control device 70, whereby predetermined printing is performed on the recording medium P. In the case where the recording medium P is, for example, image receiving paper, printing is performed on the recording medium P by thermally transferring the ink of the ink film (not shown) which is conveyed together with the recording medium P.

Second Embodiment

Figure 9:
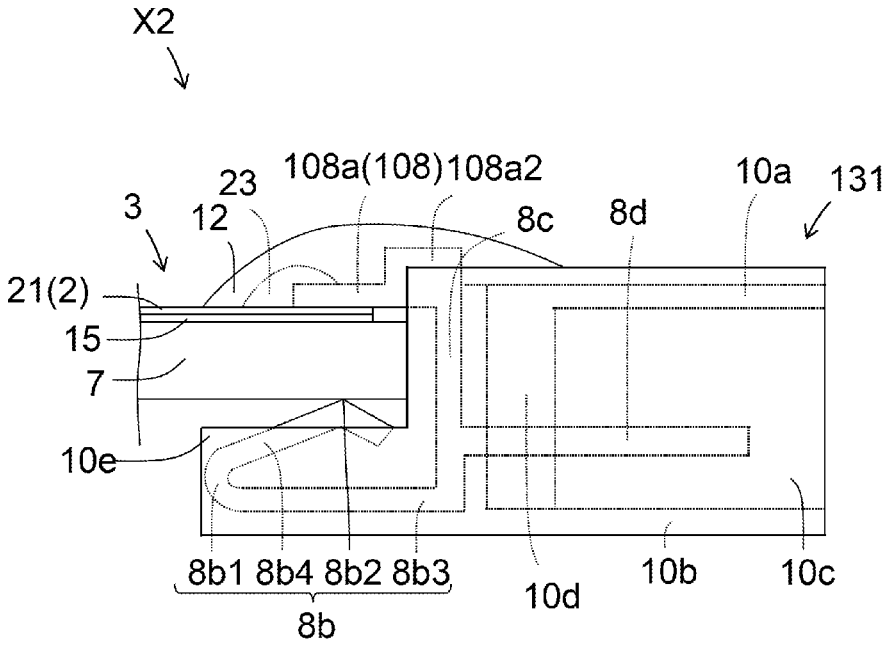
FIG. 9 is a side view showing a thermal head according to a second embodiment.

A thermal head X2 will be described referring to FIG. 9. The same members are designated by the same reference numerals and signs, and this is applied similarly to the following descriptions.

A connector pin 108 is different from the connector pin 8 in the shape of the fixing pin 108*a* thereof. The fixing pin 108*a* has a thick wall section 108*a*2 on the connection pin 8*c* side. In other words, the thickness of the portion of the fixing pin 108*a* on the connection pin 8*c* side is larger than the thickness of the portion of the fixing pin 108*a* on the substrate 7 side and the thickness of the fixing pin 108*a* changes intermittently.

Consequently, it is possible to improve the strength of the joining portion between the fixing pin 108*a* and the connection pin 8*c*. As a result, even in the case where a pressing force is exerted to the fixing pin 108*a* from below, it is possible to reduce the possibility that the fixing pin 108*a* may be broken.

The upper end of the fixing pin 108*a* is located above the highest portion of the housing 10. In other words, the upper end of the fixing pin 108*a* is provided higher than the side walls 10*c*. Even in this case, it is possible to improve the strength of the joint portion between the fixing pin 108*a* and the connection pin 8*c*.

Third Embodiment

Figure 10:
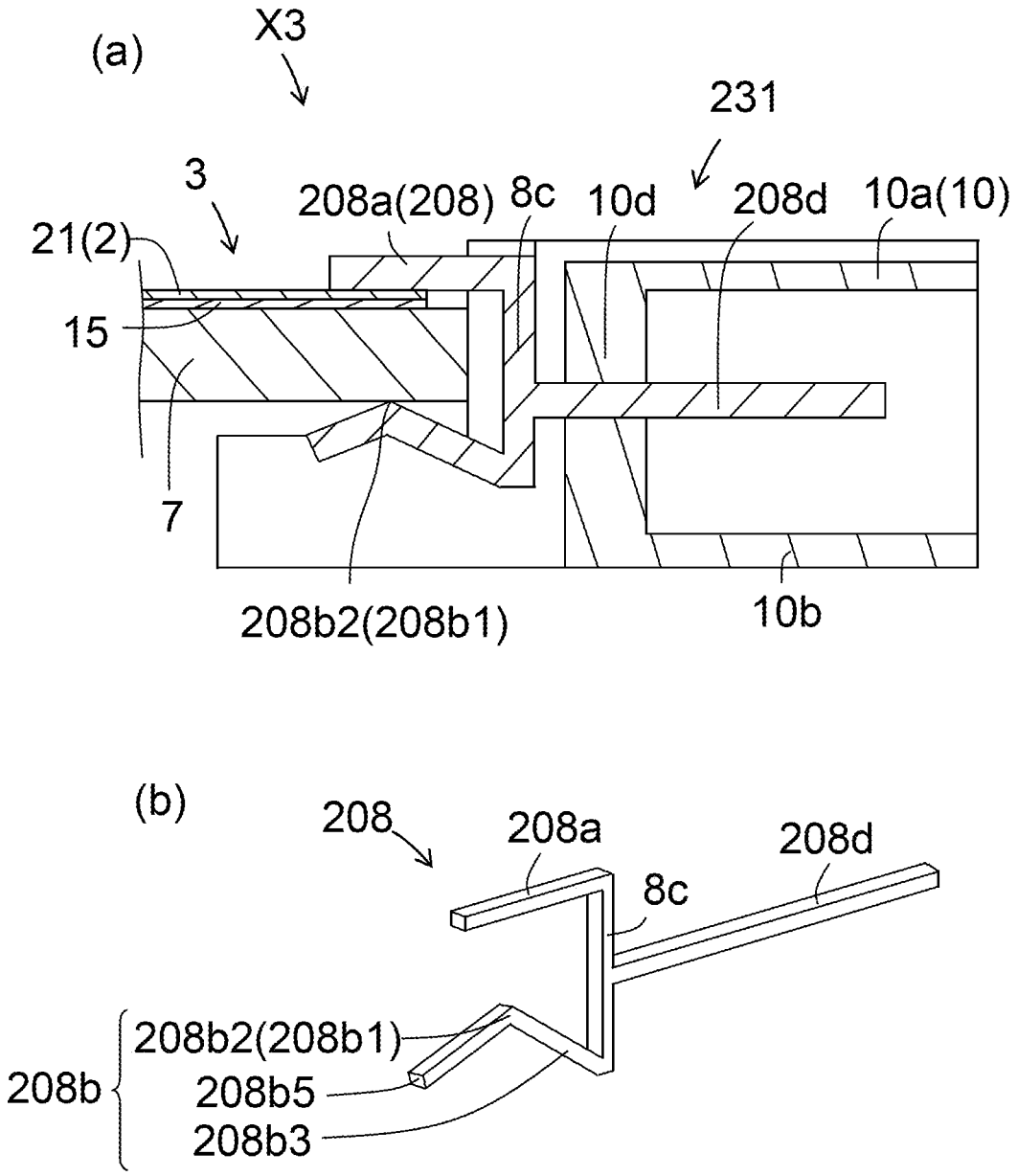
FIG. 10 shows a thermal head according to a third embodiment.

A thermal head X3 will be described referring to FIG. 10.

A connector 231 includes connector pins 208 and the housing 10. The connector pin 208 includes a fixing pin 208*a*, a movable pin 208*b*, the connection pin 8*c* and an extraction pin 208*d*. The fixing pin 208*a* has a constant thickness and is disposed on the connection terminal 2.

The movable pin 208*b* includes a movable section 208*b*1, a contact section 208*b*2, a first extension section 208*b*3 and a third extension section 208*b*5. The movable section 208*b*1 is formed into a bent shape and is configured so as to make contact with the lower face of the substrate 7. Hence, the connector pin 208 is configured so that the movable pin 208*b*1 also serves as the contact section 208*b*2. The first extension section 208*b*3 extends from the connection pin 8*c* toward the substrate 7 and is connected to the movable section 208*b*1. The third extension section 208*b*5 is disposed so as to extend from the contact section 208*b*2 toward the substrate 7. The extraction pin 208*d* is extracted from the central portion of the connection pin 8*c* in the thickness direction, and the extraction pin 208*d* is disposed above the contact section 208*b*2.

When the substrate 7 is inserted into the connector 231, the movable sections 208*b*1 of the movable pins 208*b* are deformed downwardly, whereby a clearance can be formed between the fixing pins 208*a* and the substrate 7. As a result, it is possible to reduce the possibility that the connection terminals 2 may be shaved when the substrate 7 is inserted, and to ensure the reliability of the electrical connection between the thermal head X1 and the outside.

In addition, the movable pin 208*b* includes the third extension section 208*b*5. Hence, the movable pin 208*b* can be deformed downwardly by bringing the substrate 7 into contact with the third extension section 208*b*5. As a result, the substrate 7 can be fitted into the connector 231 easily.

Fourth Embodiment

Figure 11:
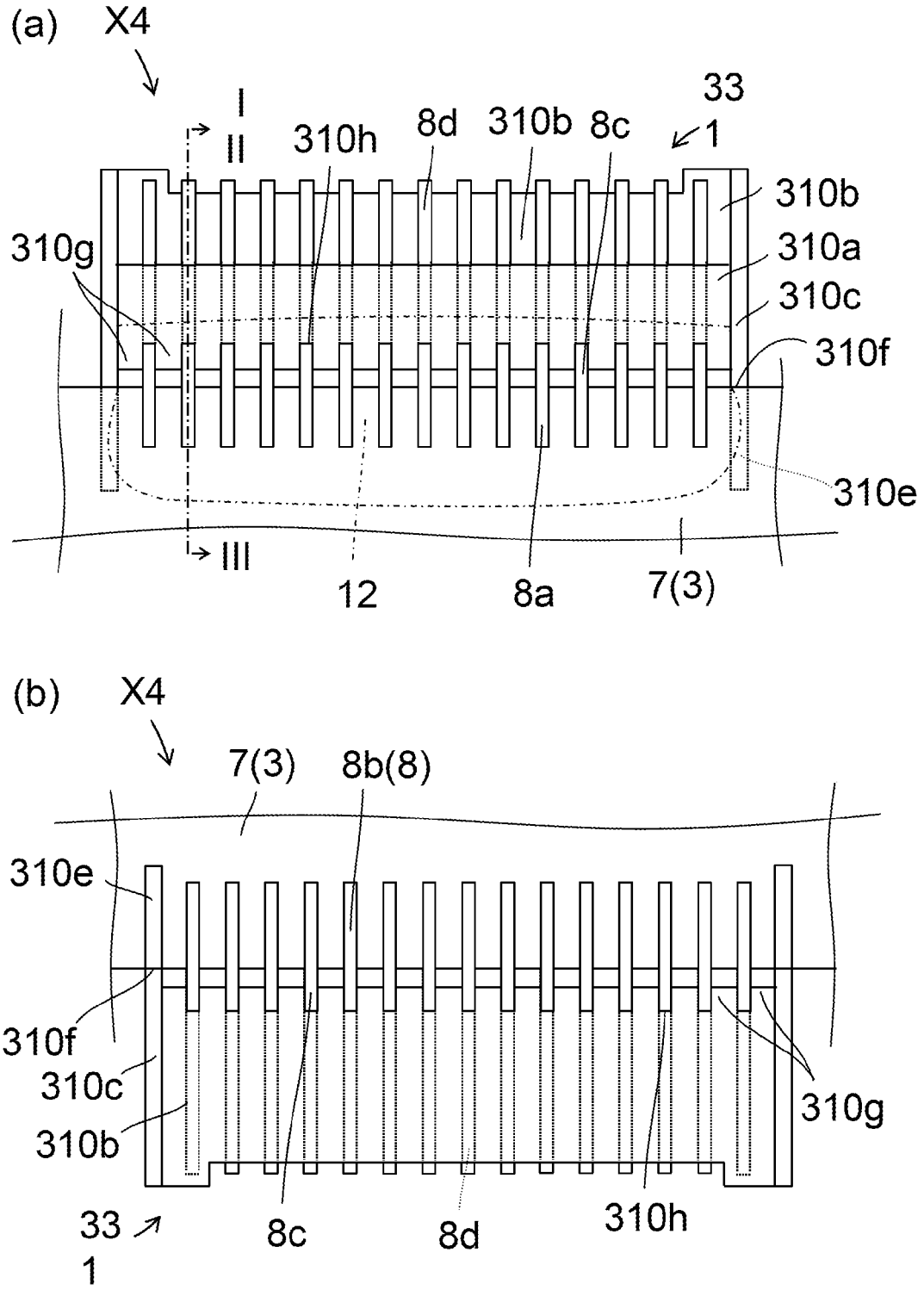
FIG. 11 is an enlarged view showing the vicinity of a connector of a thermal head according to a fourth embodiment, wherein FIG. 11(*a*) is a plan view, and FIG. 11(*b*) is a bottom view.
Figure 12:
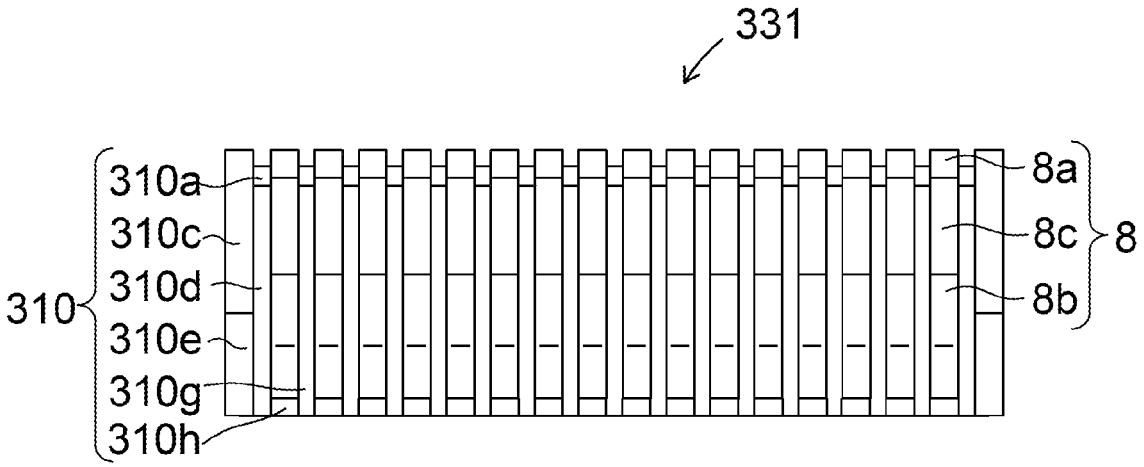
FIG. 12(*a*) is a front view showing a connector constituting the thermal head according to the fourth embodiment.
Figure 12:
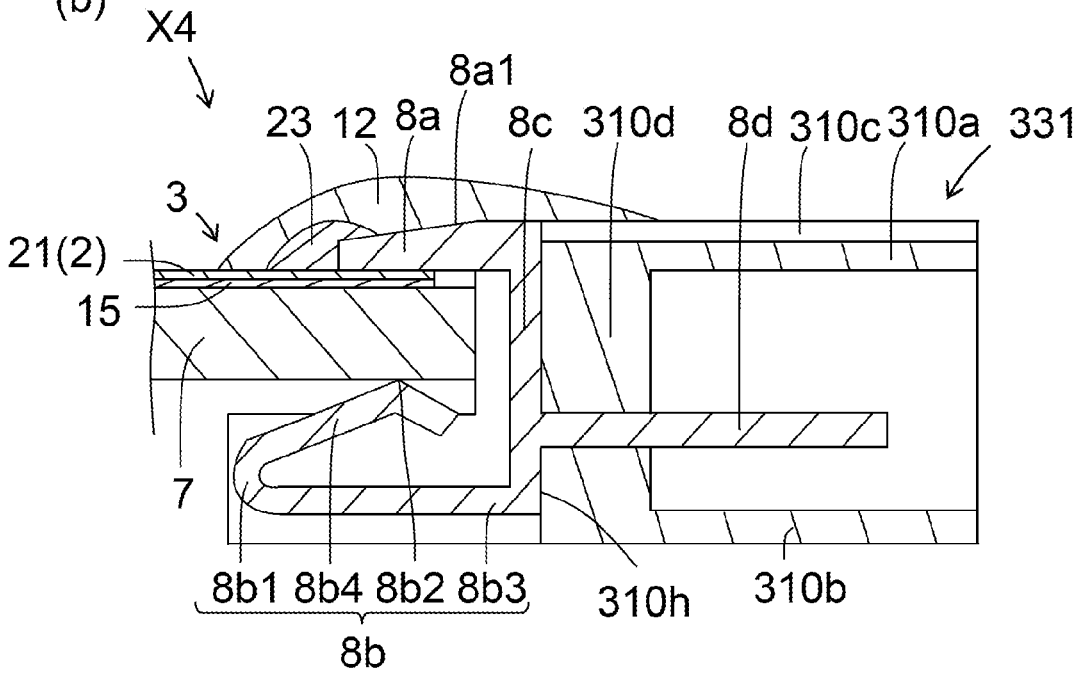

A thermal head X4 will be described referring to FIGS. 11 and 12.

A housing 310 includes an upper wall 310*a*, a lower wall 310*b*, side walls 310*c*, a front wall 310*d*, support sections 310*e*, positioning sections 310*f*, protruding sections 310*g* and groove sections 310*h*. The groove sections 310*h* are disposed so as to extend in the thickness direction of the substrate 7 while being mutually arranged at intervals in the main scanning direction. The protruding sections 310*g* are each formed between the groove sections 310*h* adjacent to each other. Similarly, the groove sections 310*h* and the protruding sections 310*g* are also formed on the upper wall 310*a* and the lower wall 310*b*.

The connection pin 8*c* of the connector pin 8 is disposed in the groove section 310*h*, and part of the connection pin 8*c* is disposed in the groove section 310*h*. Hence, it is possible to improve the strength of the fixing pin 8*a* connected to the connection pin 8*c*. Furthermore, the movable pin 8*b* is deformed about the connection pin 8*c* disposed in the groove section 310*h*, whereby the deformation of the movable pin 8*b* is less prone to be transmitted to the fixing pin 8*a*. As a result, it is possible to reduce the possibility that the fixing pin 8*a* may be separated from the connection terminal 2 (see FIG. 1).

Still further, since the connection pin 8*c* is disposed in the groove section 310*h*, part of the connection pin 8*c* is joined to the front wall 310*d* of the housing 310, and the connector pin 8 is joined to the housing 310. Hence, the connection pin

8*c* is fixed, and the movable pin 8*b* is deformed about the joining section between the connection pin 8*c* and the first extension section 8*b*3. As a result, when a pressing force is exerted to the movable pin 8*b* from above, the first extension section 8*b*3 thereof can be deformed downwardly, whereby the deformation amount of the movable pin 8*b* can be increased. For this reason, the substrate 7 can be inserted easily between the fixing pins 8*a* and the movable pins 8*b*, and the manufacturing efficiency can be improved.

Furthermore, since the connection pin 8*c* is disposed in the groove section 310*h*, the connector pin 8 is supported by the protruding sections 310*g*. As a result, even in the case where an external force is exerted to the housing 310 by connecting/disconnecting a cable, it is possible to reduce the possibility that the connector pins 8 may be separated from the housing 310.

In addition, the extraction pin 8*d* is disposed below the contact section 8*b*2. In other words, the connector pin 8 is fixed to the housing 310 at a position below the contact section 8*b*2 at which the substrate 7 makes contact with the movable pins 8*b*.

For this reason, the connection pin 8*c* which connects the extraction pin 8*d* to the movable pin 8*b* can be deformed, whereby the movable pin 8*b* is configured so as to be deformed more easily and the deformed movable pin 8*b* is configured so as to be less prone to protrude from the lower end of the housing 310. In other words, the movable pin 8*b* can be elastically deformed easily, and it is possible to reduce the possibility that the movable pin 8*b* may protrude from the housing 310. As a result, the substrate 7 can be inserted efficiently, and it is possible to reduce the possibility that the movable pins 8*b* may make contact with other components constituting the thermal head X4, such as the radiator 1.

Fifth Embodiment

Figure 13:
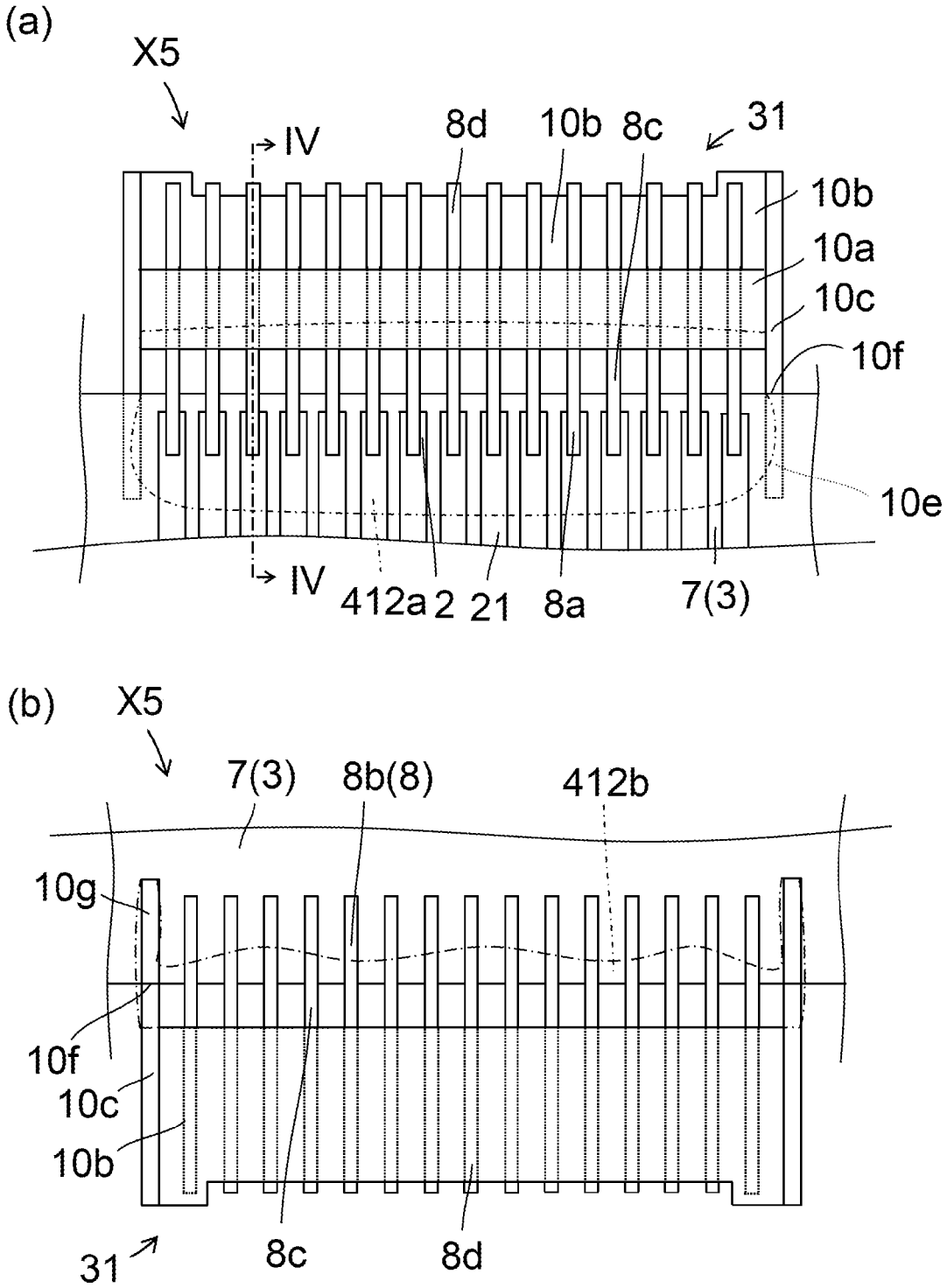
FIG. 13 is an enlarged view showing the vicinity of a connector of a thermal head according to a fifth embodiment, wherein FIG. 13(*a*) is a plan view, and FIG. 13(*b*) is a bottom view.
Figure 14:
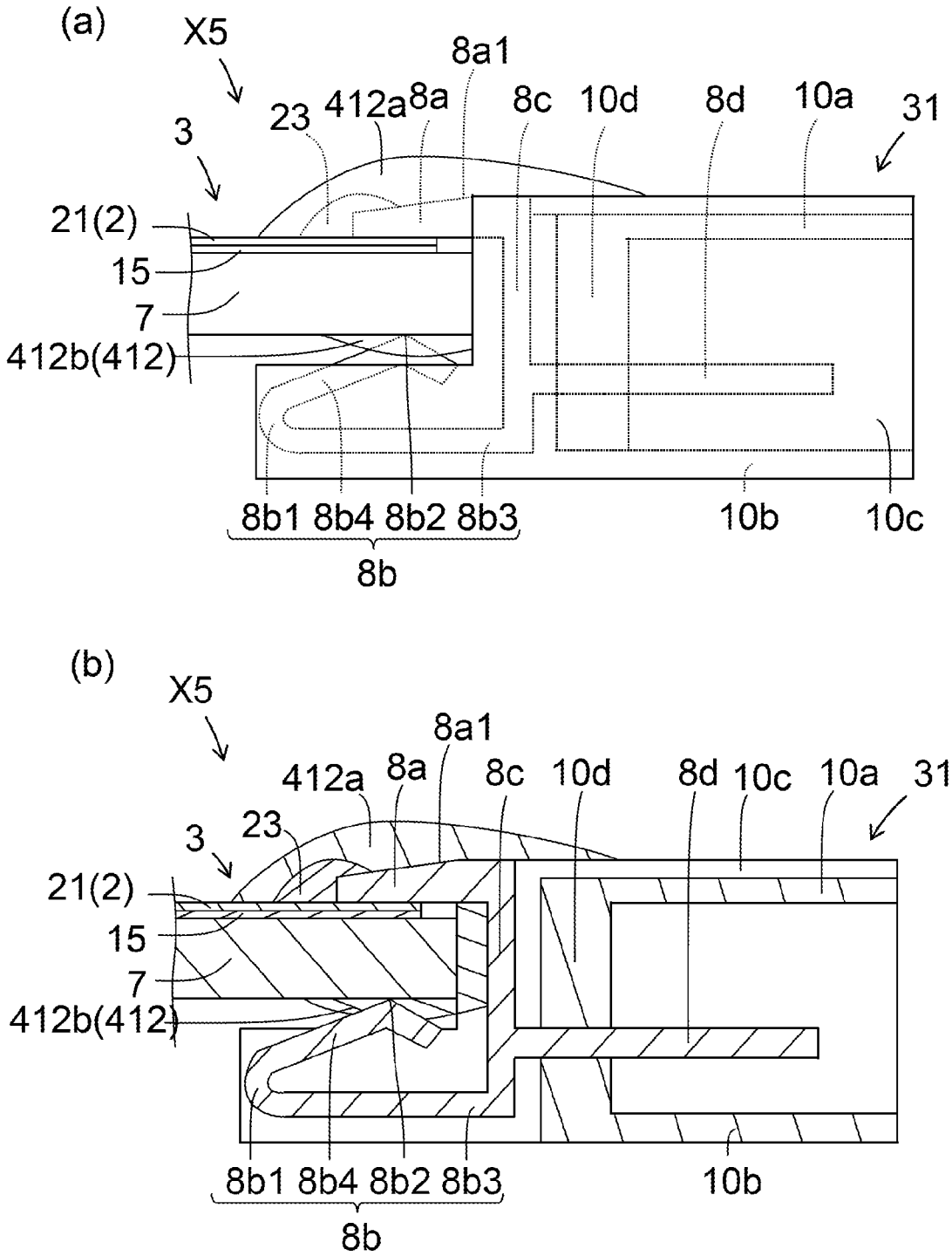
FIG. 14 shows the thermal head of FIG. 13, wherein FIG. 14(*a*) is a side view, and FIG. 14(*b*) is a cross-sectional view taken along the line IV-IV of FIG. 13(*a*)

A thermal head X5 will be described referring to FIGS. 13 and 14. The covering member 412 of the thermal head X5 is different from the covering member 12 of the thermal head X1, but the thermal head X5 is the same as the thermal head X1 in the other respects.

The covering member 412 includes a first covering member 412*a* and a second covering member 412*b*. The first covering member 412*a* is disposed on the fixing pin 8*a* side so that the connection terminal 2 and the fixing pin 8*a* are not exposed to the outside. The second covering member 412*b* is disposed on the movable pin 8*b* side so that part of the movable pin 8*b* is exposed. Since the first covering member 412*a* and the second covering member 412*b* are disposed, it is possible to enhance the joining strength between the head base body 3 and the connector 31.

The first covering member 412*a* and the second covering member 412*b* can be formed of an epoxy-based thermosetting resin or an ultraviolet curing resin. The first covering member 412*a* and the second covering member 412*b* may be formed of the same material or may be formed of different materials, In the thermal head X1 shown in FIG. 6, the fixing pin 8*a* is connected to the connection terminal 2 electrically and mechanically with the conductive joining material 23, whereby the joining between the fixing pin 8*a* and the connection terminal 2 is strong. On the other hand, the movable pin 8*b* makes contact with the substrate 7 only at the contact section 8*b*2, whereby the joining strength thereof to the substrate 7 is lower than that of the fixing pin 8*a*.

In addition, the connector pin 8 may be deformed in some cases when the housing 10 expands due to the heat generated during the driving of the thermal head X1. Since the fixing pin 8*a* is fixed to the connection terminal 2 with the conductive joining material 23 at the time, the movable pin 8*b* is liable to be deformed. As a result, the covering member 12 located around the movable pin 8*b* may be peeled in some cases.

On the other hand, the covering member 412 covers the fixing pin 8*a* part of the movable pin 8*b* and not to cover the remaining part of the movable pin 8*b*. Hence, even in the case where the housing 10 and the connector pin 8 expand due to heat, it is possible to ensure the degree of freedom of the movable pin 8*b*, and to reduce the binding force by the resin. Consequently, stress is less prone to be generated in the second covering member 412*b* located around the movable pin 8*b*.

As a result, it is possible to reduce the possibility that the second covering member 412*b* located around the movable pin 8*b* may be peeled, and to ensure the joining strength of the connector 31. Hence, it is possible to reduce the possibility that the connector 31 may be separated from the substrate 7.

Furthermore, the movable pin 8*b* includes the movable section 8*b*1, the contact section 8*b*2, the first extension section 8*b*3 and the second extension section 8*b*4, the first covering member 412*a* is disposed so as to cover the fixing pin 8*a*, the second covering member 412*b* is disposed so that part of the movable pin 8*b* is exposed, and the first extension section 8*b*3 is exposed from the second covering member 412*b*. Hence, even if the connector pin 8 is deformed so as to extend, since the first extension section 8*b*3 is deformed, it is possible to relieve the elongation occurring in the connector pin 8.

In other words, although the elongation of the connector pin 8 is transmitted from the fixing pin 8*a* to the movable pin 8*b* via the connection pin 8*c*, since the first extension section 8*b*3 functions as a portion for relieving the elongation of the connector pin 8, stress is less prone to be generated in the second covering member 412*b* located around the movable pin 8*b*. As a result, it is possible to reduce the possibility that the second covering member 412*b* may be peeled.

In addition, the second covering member 412*b* is disposed so as to cover the contact section 8*b*2. Hence, the second covering member 412*b* functions so as to join the substrate 7 to the contact section 8*b*2. As a result, the contact section 8*b*2 is not exposed, and it is possible to improve the joining strength between the substrate 7 and the connector 31.

In addition, a portion of the connection pin 8*c* on the fixing pin 8*a* side is covered with the first covering member 412*a*, and a portion of the connection pin 8*c* on the movable pin 8*b* side is exposed from the second covering member 412*b*. Hence, the portion of the connection pin 8*c* on the movable pin 8*b* side exposed from the second covering member 412*b* can be deformed freely. As a result, the connection pin 8*c* can be deformed so as to relieve the elongation of the connector pin 8. For this reason, stress is less prone to be generated in the second covering member 412*b* disposed around the contact section 8*b*2 of the movable pin 8*b*, and it is possible to reduce the possibility that the second covering member 412*b* may be peeled.

The portion of the connection pin 8*c* on the fixing pin 8*a* side represents the region ranging from 15 to 25% in the extension direction length of the connection pin 8*c* from the end portion of the connection pin 8*c* to which the fixing pin 8*a* is connected, and the portion of the connection pin 8*c* on the movable pin 8*b* side represents the region ranging from 15 to 25% in the extension direction length of the connection pin 8*c* from the end portion of the connection pin 8*c* to which the movable pin 8*b* is connected.

Still further, the first covering member 412*a* preferably seals the fixing pin 8*a* or the contact section 8*b*2. In the case where the first covering member 412*a* seals the fixing pin 8*a* or the contact section 8*b*2, it is possible to enhance the sealability of the fixing pin 8*a* and to improve the joining strength of the contact section 8*b*2.

Sixth Embodiment

Figure 15:
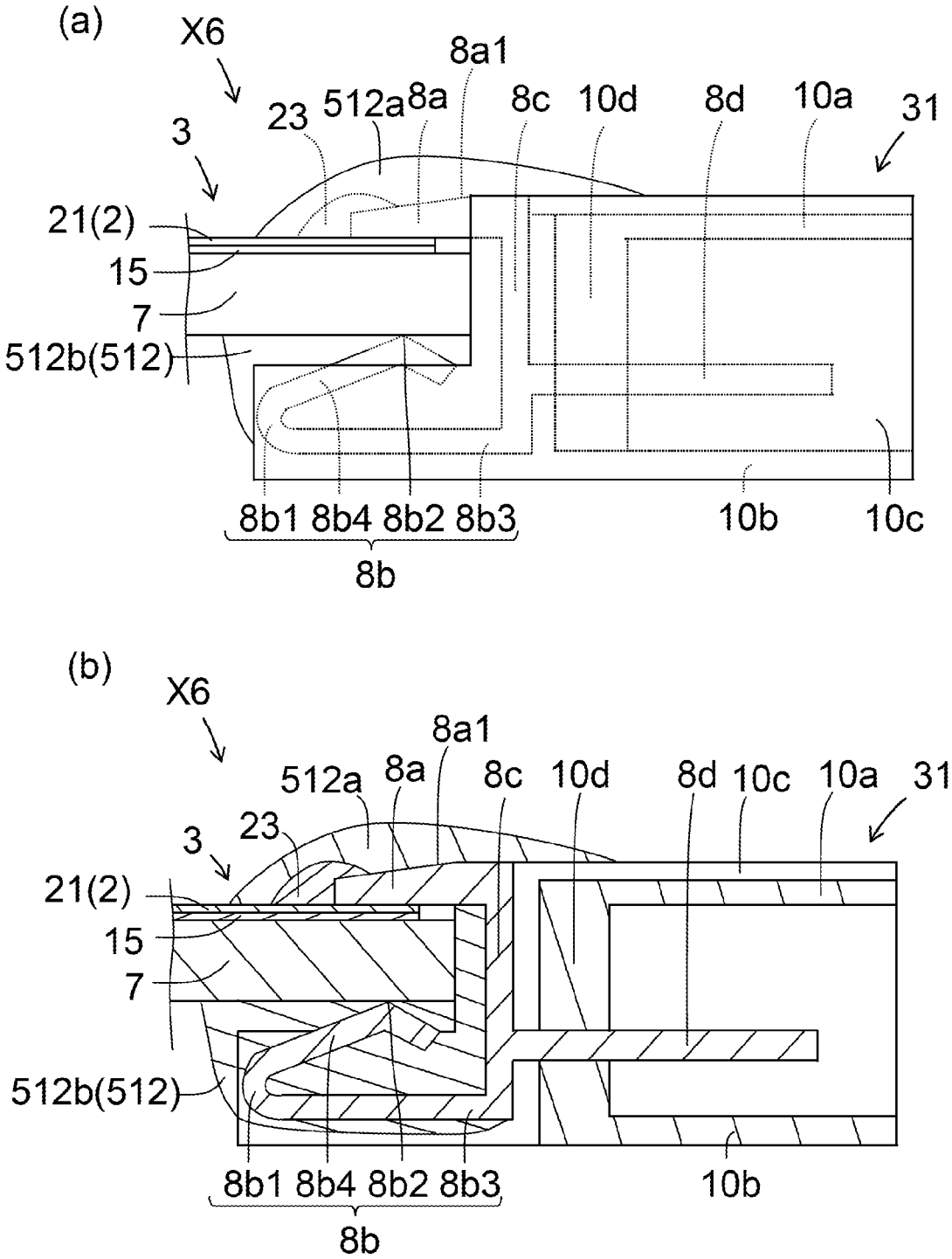
FIG. 15 shows a thermal head according to a sixth embodiment, wherein FIG. 15(*a*) is a side view, and FIG. 15(*b*) is a cross-sectional view.

A thermal head X6 will be described referring to FIG. 15. The covering member 512 of the thermal head X6 is different from the covering member 12 of the thermal head X1, but the thermal head X6 is the same as the thermal head X1 in the other respects.

The covering member 512 of the thermal head X6 includes a first covering member 512*a* and a second covering member 512*b*. The first covering member 512*a* is disposed on the fixing pin 8*a*, and the second covering member 512*b* is disposed on the movable pin 8*b*. The first covering member 512*a* is disposed so as to seal the fixing pin 8*a* as shown in FIG. 15(*a*). The second covering member 512*b* is disposed so as to seal the movable pin 8*b* as shown in FIG. 15(*b*). Furthermore, the hardness of the second covering member 512*b* is made smaller than that of the first covering member 512*a*.

The first covering member 512*a* can be formed of, for example, an epoxy-based thermosetting resin, and the Shore D hardness thereof is preferably D80 to 100. Furthermore, the thermal expansion coefficient thereof is preferably 10 to 20 ppm at normal temperature.

The second covering member 512*b* can be formed of, for example, an epoxy-based thermosetting resin, and the Shore D hardness thereof is preferably D60 to 80. Furthermore, the thermal expansion coefficient thereof is preferably 60 to 100 ppm at normal temperature.

The hardness values of the first covering member 512*a* and the second covering member 512*b* can be measured using, for example, a JIS K 6253 durometer (type D). For example, the hardness values at three arbitrary points on the first covering member 512*a* are measured using the durometer, and the average of the values is calculated and can be set as the hardness of the first covering member 512*a*. The hardness of the second covering member 512*b* can also be obtained similarly. Instead of the durometer, a Shore hardness meter or the like may also be used for the measurement.

In the thermal head X6, the hardness of the second covering member 512*b* is lower than that of the first covering member 512*a*. Hence, even in the case where thermal expansion occurs in the connector pin 8, the second covering member 512*b* can follow the deformation of the movable pin 8*b* because the hardness of the second covering member 512*b* located around the movable pin 8*b* is low.

As a result, it is possible to relieve the stress generated inside the second covering member 512*b* and to reduce the possibility that the second covering member 512*b* may be peeled, whereby it is possible to ensure the joining strength of the connector 31. Hence, it is possible to reduce the possibility that the connector 31 may be separated from the substrate 7.

In addition, the thermal expansion coefficient of the second covering member 512*b* is preferably larger than that of the first covering member 512*a*. Thereby, the second covering member 512*b* can follow the deformation of the movable pin 8*b*. As a result, it is possible to relieve the stress generated inside the second covering member 512*b* due to the elongation of the connector pin 8.

The thermal expansion coefficient of the second covering member 512*b*, however, is not necessarily required to be larger than that of the first covering member 512*a*.

Although the embodiments according to the invention have been described above, the invention is not limited to the above-mentioned embodiments, but various modifications are possible without departing from the scope of the invention. For example, the thermal printer Z1 incorporating the thermal head X1 according to the first embodiment has been described, but without being limited to this, the thermal heads X2 to X6 may be used for the thermal printer Z1. Moreover, the thermal heads X1 to X6 according to the plurality of embodiments may be combined.

Although the example in which the connector 31 is disposed at the central portion in the arrangement direction is taken in the descriptions of the thermal heads X1 to X6, the connectors may be disposed at both end portions in the arrangement direction.

In addition, without forming the protruding section 13*b* on the heat storage layer 13, the heat generating sections 9 of the electric resistance layer 15 may be disposed on the base section 13*a* of the heat storage layer 13. Furthermore, the heat storage layer 13 may be disposed over the entire region of the upper face of the substrate 7.

Furthermore, the heat generating sections 9 may be configured by forming the common electrode 17 and the individual electrodes 19 on the heat storage layer 13 and by forming the electric resistance layer 15 only in the region between the common electrode 17 and the individual electrodes 19.

Still further, although the thin-film head including the heat generating sections 9 which are small in thickness by performing thin film formation of the electric resistance layer 15 has been described as an example, the head is not limited to this head. For example, the invention may be applied to a thick-film head including the heat generating sections 9 which are large in thickness by performing thick film formation of the electric resistance layer 15. Furthermore, this technology may be used for an end-face head in which the heat generating sections 9 are formed on the end face of the substrate.

The covering member 12 and the hard coat 29 which covers the drive ICs 11 may be made of the same material. In such a case, the hard coat 29 and the covering member 12 may be formed simultaneously by printing the hard coat 29 in the region in which the covering member 12 is formed at the time of printing the hard coat 29.

REFERENCE SIGNS LIST

X1-X6: Thermal head
Z1: Thermal printer
1: Radiator
2: Connection terminal
3: Head base body
4: Ground electrode
7: Substrate
8: Connector pin
8*a*: Fixing pin
8*b*: Movable pin
8*b*1: Movable section
8*b*2: Contact section
8*b*3: First extension section
8*b*4: Second extension section
8*c*: Connection pin

8*d*: Extraction pin
9: Heat generating section
10: Housing
10*a*: Upper wall
10*b*: Lower wall
10*c*: Side wall
10*d*: Front wall
10*e*: Support section
10*f*: Positioning section
10*g*: Protruding section
11: Drive IC
12: Covering member
13: Heat storage layer
15: Electric resistance layer
17: Common electrode
19: Individual electrode
21: IC-connector connection electrode
23: Conductive joining material
25: Protection layer
26: IC-IC connection electrode
27: Covering layer
29: Hard coat

The invention claimed is:

1. A thermal head, comprising:
a substrate,
a heat generating section disposed on the substrate,
an electrode which is disposed on the substrate and is electrically connected to the heat generating section, and
a connector comprising a fixing pin electrically connected to the electrode, a movable pin which holds the substrate between the movable pin and the fixing pin, and a connection pin which connects the fixing pin to the movable pin,
the movable pin comprising a movable section which is bent or curved and a contact section making contact with the substrate,
the movable pin being disposed so as to protrude from the connection pin beyond the fixing pin, and
the contact section being located closer to a connection pin side than a tip end of the fixing pin.

2. The thermal head according to claim 1, wherein the fixing pin includes a thick wall section on a connection pin side.

3. The thermal head according to claim 1, wherein the fixing pin has an inclined region whose thickness becomes larger toward the connection pin.

4. The thermal head according to claim 1,
wherein the connector further comprises a housing, and
part of the connection pin is joined to the housing.

5. The thermal head according to claim 1,
wherein the connector further comprises a housing, and
an upper end of the fixing pin is located below a highest portion of the housing.

6. The thermal head according to claim 4,
wherein the connector further comprises an extraction pin extracted from the connection pin, and
part of the extraction pin is joined to the housing at a position lower than the contact section.

7. The thermal head according to claim 1,
wherein the movable pin includes a first extension section which extends from the connection pin toward the substrate and is connected to the movable section, and a second extension section which extends from the movable section toward the connection pin and is connected to the contact section.

8. The thermal head according to claim 7, further comprising a covering member disposed on the fixing pin and the movable pin,
wherein the covering member is disposed so as to cover the fixing pin and part of the movable pin and not to cover a remaining part of the movable pin, and
the first extension section is exposed from the covering member.

9. The thermal head according to claim 1, further comprising a covering member disposed on the fixing pin and the movable pin,
wherein the covering member is disposed so as to cover the fixing pin and part of the movable pin and not to cover a remaining part of the movable pin.

10. The thermal head according to claim 9, wherein the contact section is covered with the covering member.

11. The thermal head according to claim 9, wherein a portion of the connection pin on a fixing pin side is covered with the covering member and a portion of the connection pin on a movable pin side is not covered with the covering member.

12. The thermal head according to claim 9,
wherein the covering member includes a first covering member disposed on a fixing pin side, and a second covering member disposed on a movable pin side, and
a hardness of the second covering member is lower than that of the first covering member.

13. The thermal head according to claim 1, further comprising:
a first covering member disposed on the fixing pin and
a second covering member disposed on the movable pin,
wherein a hardness of the second covering member is lower than that of the first covering member.

14. A thermal printer, comprising:
the thermal head according to claim 1,
a conveying mechanism which conveys a recording medium onto the heat generating section and
a platen roller which presses the recording medium against the heat generating section.

15. A thermal head, comprising:
a substrate,
a heat generating section disposed on the substrate,
an electrode which is disposed on the substrate and is electrically connected to the heat generating section,
a connector comprising a fixing pin electrically connected to the electrode, a movable pin which holds the substrate between the movable pin and the fixing pin, and a connection pin which connects the fixing pin to the movable pin, and
a covering member disposed on the fixing pin and the movable pin,
wherein the covering member is disposed so as to cover the fixing pin and part of the movable pin and not to cover a remaining part of the movable pin.

16. The thermal head according to claim 15,
wherein the movable pin comprising a movable section which is bent or curved and a contact section making contact with the substrate,
wherein the covering member is disposed so as to cover the fixing pin and part of the movable pin and not to cover a remaining part of the movable pin.

17. A thermal printer, comprising:
the thermal head according to claim 15,
a conveying mechanism which conveys a recording medium onto the heat generating section and
a platen roller which presses the recording medium against the heat generating section.

18. A thermal head, comprising:

a substrate, a heat generating section disposed on the substrate, an electrode which is disposed on the substrate and is electrically connected to the heat generating section, a connector comprising a fixing pin electrically connected to the electrode, a movable pin which holds the substrate between the movable pin and the fixing pin, and a connection pin which connects the fixing pin to the movable pin, a first covering member disposed on the fixing pin, and a second covering member disposed on the movable pin, wherein a hardness of the second covering member is lower than that of the first covering member.

19. The thermal head according to claim 18, wherein a thermal expansion coefficient of the second covering member is lower than a thermal expansion coefficient of the first covering member.

20. A thermal printer, comprising:

the thermal head according to claim 18, a conveying mechanism which conveys a recording medium onto the heat generating section and a platen roller which presses the recording medium against the heat generating section.

* * * * *